US005329904A

United States Patent [19]

Kokubo et al.

[11] Patent Number: 5,329,904

[45] Date of Patent: Jul. 19, 1994

[54] ENGINE CONTROL APPARATUS FOR DISCRIMINATING CYLINDERS

[75] Inventors: Naoki Kokubo, Aichi; Koji Sakakibara, Hekinan; Hiroshi Haraguchi, Kariya, all of Japan

[73] Assignee: Nippondenso Co., Ltd., Kariya, Japan

[21] Appl. No.: 101,294

[22] Filed: Aug. 3, 1993

[30] Foreign Application Priority Data

Aug. 4, 1992 [JP] Japan ..... 4-208081
Nov. 30, 1992 [JP] Japan ..... 4-320007
Jun. 15, 1993 [JP] Japan ..... 5-143491

[51] Int. Cl.[5] ..... F02P 5/155; F02P 7/067

[52] U.S. Cl. ..... 123/414; 123/612; 123/643

[58] Field of Search ..... 123/414, 476, 612, 613, 123/617, 643

[56] References Cited

U.S. PATENT DOCUMENTS 4,787,355 11/1988 Maeda ..... 123/414
4,924,830 5/1990 Abe ..... 123/414 X
4,953,531 9/1990 Abe ..... 123/414
5,156,125 10/1992 Fukui et al. ..... 123/414
5,184,590 2/1993 Hashimoto et al. ..... 123/414
5,209,202 5/1993 Maurer et al. ..... 123/414
5,267,544 12/1993 Ohkumo et al. ..... 123/414

FOREIGN PATENT DOCUMENTS 60-138251 7/1985 Japan .
3172558 7/1991 Japan .

*Primary Examiner*—Willis R. Wolfe
*Attorney, Agent, or Firm*—Cushman, Darby & Cushman

[57] ABSTRACT

An engine control apparatus for discriminating each cylinder of an engine comprises a crank angle rotor (M1) having a configuration representing a crank angle of an engine; a crank angle sensor (M2) operatively associated with the crank angle rotor (M1) to generate a crank angle signal in accordance with the configuration of the crank angle rotor (M1). The configuration of the crank angle rotor (M1) includes first and second silent sections. The first silent section is cooperative with the crank angle sensor (M1) to constitute a part (M3) for generating a first level non-pulsation component of the crank angle signal. The second silent section being cooperative with said crank angle sensor to constitute a part (M4) for generating a second level non-pulsation component of the crank angle signal. There is further provided a cam angle rotor (M5) having a configuration representing a cam angle, which is operatively associated with a cam angle sensor (M6) for generating a cam angle signal to provide a plurality of different kinds of signal level sequences with respect to the first and second silent sections of the crank angle rotor. A cylinder discriminating device (M7) discriminates each cylinder of the engine on the basis of the level of the non-pulsation component of the crank angle signal and the signal level sequences of the cam angle signal.

13 Claims, 33 Drawing Sheets

TDC POSITION AFTER AB

| A | B | CYL |
|---|---|---|
| H | H | #5 |
| H | L | #2 |
| L | H | #3, 6 |
| L | L | #1, 4 |

FIG. 11

| CYLINDER | #1 | #8 | #4 | #3 | #6 | #5 | #7 | #2 |
|---|---|---|---|---|---|---|---|---|
| NON-PULSATION SIGNAL LEVEL (N1) | L | L | H | H | L | L | H | H |
| CAM SIGNALS G1 | L | H | L | H | L | H | L | H |
| CAM SIGNALS G2 | L | H | L | H | H | L | H | L |
| PORT OUTPUT | 0 | 1 | 2 | 3 | 4 | 5 | 6 | 7 |

START
S1
INITIAL SETTING
SECTION INTERVAL T1←MAX
CRANK SIGNAL N1← 0
CAM SIGNAL G1← 0
NON-PULSATION SECTION C ← 0
ANGLE COUNTER NE← 0
TIMER T ← 0
S2
A
S17
T1←T2, G1←G2, N1←N2
EDGE DETECTION FROM CRANK SIGNAL
S3
SECTION TIME T2←T
T←0
S4
N2←CRANK SIGNAL
G2←CAM SIGNAL
S5
S6
T2>K*T1 ?
NO
YES
C←1
S7
CYLINDER DISCRIMINATION
S8
CYL PORT SET
S9
NE←2
S10
S11
N2=1 ?
NO
YES
NE←NE+C
S12
S13
NE≧3 ?
NO
YES
NE PORT←1
S14
NE←0
S15
S16
NE PORT←0
A

| N1 | L | | H | |
|---|---|---|---|---|
| N2 | L | H | L | H |
| GROUP | #8, 5 | #4, 7 | #1, 6 | #3, 2 |

FIG. 17

| CYL | NE LEVEL AT Gc ⑤ | NE LEVEL AT Gc ⑦ | NE ⑤ COUNT BETWEEN Gc ⑤ & ⑦ |
|---|---|---|---|
| #1 | Lo | Lo | 1 |
| #5 | Hi | Hi | 1 |
| #3 | Hi | Lo | 1 |
| #6 | Lo | Lo | 2 |
| #2 | Hi | Hi | 2 |
| #4 | Hi | (Lo) | 3 |

| LEVEL SEQUENCE | LL | | LH | | HL | | HH | |
|---|---|---|---|---|---|---|---|---|
| G EDGE | YES | NO | YES | NO | YES | NO | YES | NO |
| CYLINDER NO. | #1 | #6 | #8 | #5 | #4 | #7 | #3 | #2 |

| LEVEL SEQUENCE | LL | | LH | | HL | |
|---|---|---|---|---|---|---|
| G EDGE | YES | NO | YES | NO | YES | NO |
| CYLINDER NO. | #1 | #4 | #2 | #5 | #3 | #6 |

| LEVEL SEQUENCE | LL | | HH | |
|---|---|---|---|---|
| G EDGE | YES | NO | YES | NO |
| CYLINDER NO. | #1 | #4 | #3 | #2 |

| CYLINDER NO. | #1 | #8 | #4 | #3 | #6 | #5 | #7 | #2 |
|---|---|---|---|---|---|---|---|---|
| G1 bit3-1, 0 | 00 | 00 | 01 | 01 | 10 | 10 | 11 | 11 |
| G2 bit3-1, 0 | 00 | 01 | 00 | 01 | 00 | 01 | 00 | 01 |

| CYLINDER NO. | #1 | #2 | #3 | #4 | #5 | #6 |
|---|---|---|---|---|---|---|
| G bit3-1, 0 | 00 | 01 | 10 | 11 | 01 | 10 |

| CYLINDER NO. | #1 | #3 | #4 | #2 |
|---|---|---|---|---|
| G bit3-1, 0 | 00 | 01 | 10 | 11 |

| NE PULSE COUNTS | 3 | | 4 | | 5 | | 6 | |
|---|---|---|---|---|---|---|---|---|
| G PULSE | YES | NO | YES | NO | YES | NO | YES | NO |
| CYLINDER NO. | #1 | #6 | #8 | #5 | #4 | #7 | #3 | #2 |

ENGINE CONTROL APPARATUS FOR DISCRIMINATING CYLINDERS

BACKGROUND OF THE INVENTION

1. Field of the Invention

The present invention relates to an engine control apparatus for controlling ignition timing and/or fuel injection timing, and more particularly to an engine control apparatus capable of accurately and promptly discriminating cylinders.

2. Description of the Prior Art

In the fields of engine control, there have been conventionally known various cylinder discriminating techniques. In such cylinder discriminating techniques, a crank angle is generally detected by a rotational sensor such as a Hall sensor or an optical sensor which generates a crank angle signal having a plurality of signal levels. A cam angle is also detected by the similar sensor, so as to be used together with the crank angle for discriminating cylinders of an engine.

One example of discriminating cylinders on the basis of these crank angle and cam angle signals is, for example, disclosed in the Unexamined Japanese Patent Application No. 3-172558/1991.

FIG. 4 illustrates the principle of the discriminating method in accordance with the teaching of the Unexamined Japanese Patent Application No. 3-172558/1991. A crank angle rotor is generally formed with numerous projections and recessions alternately disposed at the circumferential peripheral portion thereof so as to generate a pulsation signal. The circumferential peripheral portion of the crank angle rotor used in this prior art is further provided with a plurality of silent sections having no projections therein being disposed at predetermined intervals.

In FIG. 4, a crank angle sensor signal (a) has a plurality of non-pulsation components as generally denoted by a reference character (c). Reference positions (REF) are detected on the basis of these non-pulsation components (c). On the other hand, a cam angle rotor has a plurality of projections having different widths in connection with the total number of cylinders. Thus, a cam angle sensor signal (b) generates a plurality of HIGH-level sections each having a width (d). The number of these HIGH-level sections is the same as the number of cylinders. The width (d) is differentiated from each other among HIGH-level sections so that each of the cylinders can be discriminated based on the detection of pulse counts of the crank angle signal encompassed during the width (d).

Another example of discriminating cylinders on the basis of the crank angle and cam angle signals is disclosed in the Unexamined Japanese Patent Application No. 60-138251/1985.

FIG. 5 illustrates the principle of the discriminating method in accordance with the teaching of the Unexamined Japanese Patent Application No. 60-138251/1985. As shown in FIG. 5, a crank angle sensor signal alternates at regular intervals. On the other hand, a cam angle sensor signal alternates at irregular intervals. The level of the cam angle signal is detected at two points corresponding to a rise timing A and a drop timing B of the crank angle sensor signal as shown in FIG. 5. Through this detection, four signal patterns of HIGH-HIGH, HIGH-LOW, LOW-HIGH, and LOW-LOW are detected. The cylinder discrimination is then carried out on the basis of thus obtained four patterns of HIGH-HIGH, HIGH-LOW, LOW-HIGH, and LOW-LOW as shown FIG. 6.

These conventional discriminating methods are, however, disadvantageous in the following point when used in a distributorless ignition system. A major problem is that these discrimination methods cannot be applied to 8-cylinder engines. First of all, the system disclosed in the Unexamined Japanese Patent Application No. 3-172558/1991 will require to excessively enlarge the crank rotor radius. Because, the cam angle rotor needs to be formed with eight projections having mutually different widths so as to encompass 1 to 8 crank angle signal pulses therein, respectively. Secondly, the system disclosed in the Unexamined Japanese Patent Application No. 60-138251/1985 will provide only four signal patterns using HIGH and LOW-levels at best. Consequently, an additional rotation sensor will be inevitably required in the case where an ignition coil is provided per cylinder in an 8-cylinder engine.

SUMMARY OF THE INVENTION

Accordingly, an object of the present invention is to provide an engine control apparatus capable of discriminating up to eight cylinders with simple construction.

In order to accomplish above purpose, as shown in FIG. 1, a first aspect of the present invention provides an engine control apparatus comprising: a crank angle rotor (M1) having a configuration representing a crank angle of an engine; a crank angle sensor (M2) operatively associated with said crank angle rotor (M1) to generate a crank angle signal in accordance with said configuration of said crank angle rotor (M1); said configuration of said crank angle rotor (M1) including first and second silent sections, said first silent section being cooperative with said crank angle sensor (M2) to constitute a means (M3) for generating a first level non-pulsation component of said crank angle signal, and said second silent section being cooperative with said crank angle sensor (M2) to constitute a means (M4) for generating a second level non-pulsation component of said crank angle signal; a cam angle rotor (M5) having a configuration representing a cam angle of the engine; a cam angle sensor (M6) operatively associated with said cam angle rotor (M5) for generating a cam angle signal to provide a plurality of different kinds of signal level sequences with respect to said first and second silent sections of said crank angle rotor (M1); and a cylinder discriminating means (M7) for discriminating each cylinder of said engine on the basis of said first and second level non-pulsation components of said crank angle signal and said signal level sequences of said cam angle signal.

FIG. 2 shows the crank angle sensor signal and the cam angle sensor signal. As shown in FIG. 2, the crank angle sensor signal includes non-pulsation components of two, i.e. high and low, levels. On the other hand, the cam angle sensor signal provides 4 signal level sequences of L-L, L-H, H-L, and H-H with respect to corresponding non-pulsation components of the crank angle sensor signal. Combining these two sensor signals, therefore, provides 8 different kinds signal patterns, which is suitable for cylinder discrimination in an 8-cylinder engine.

It will be preferable in this first aspect of the present invention to modify an arrangement of silent sections as shown in FIG. 3. That is, said first and second silent sections of said crank angle rotor are disposed in such a manner that consecutive two first silent sections are followed by consecutive two second silent sections. This arrangement makes it possible to discriminate several cylinder groups even if no cam angle signal is available. Thus, there will be provided an appropriate means for discriminating an ignition group on the basis of sequence of signal levels of said silent sections.

Meanwhile, a second aspect of the present invention provides an engine control apparatus comprising: crank angle signal generating means for generating a crank angle signal of pulsation waveform in response to rotation of a crank shaft of an engine; cylinder discriminating signal generating means for generating a cylinder discriminating signal in response to rotation of a half-speed rotor rotating at a half speed of said crank shaft, said cylinder discriminating signal including a plurality of different kinds of pulses corresponding to respective cylinders of said engine; and cylinder discriminating means for discriminating each cylinder of said engine on the basis of signal level of said crank angle signal at each pulse edge of said cylinder discriminating signal and pulse edge number of said crank angle signal provided between rise and drop edges of each pulse of said cylinder discrimination signal.

It will be preferable in this second aspect of the present invention that a specific cylinder is differentiated from other cylinders in number of pulse edges of said crank angle signal encompassed between said rise and drop edges of each pulse of said cylinder discrimination signal.

Furthermore, a third aspect of the present invention provides an engine control apparatus comprising: a crank angle rotor for detecting a crank angle of an engine, said crank angle rotor having numerous projections and recessions alternately disposed at a circumferential peripheral portion thereof; a crank angle sensor operatively associated with said alternate projections and recessions for generating a crank angle signal of pulsation waveform; said circumferential peripheral portion of said crank angle rotor further forming silent sections for generating high and low non-pulsation signal components, said silent sections being paired so that said crank angle signal provides a plurality of different kinds of signal level sequences with respect to corresponding top dead centers of cylinders of said engine; a cam angle rotor for detecting a cam angle of said engine, said cam angle rotor having projections at a circumferential peripheral portion thereof; a cam angle sensor for operatively associated with said projections of said cam angle rotor to provide a cam angle signal having two signal level components; and a cylinder discriminating means for discriminating said cylinders of the engine on the basis of said signal level sequences of said crank angle signal and said two signal level components of said cam angle signal.

Preferably, in the third aspect of the present invention, there is further provided a means for prohibiting cylinder discrimination for a predetermined period of time after starting said engine.

Moreover, a fourth aspect of the present invention provides an engine control apparatus comprising: crank angle means for generating pulses near each top dead center of cylinders of an engine, said pulses being variously differentiated in number in accordance with respective cylinders; cam angle means for generating a cam angle signal; and a cylinder discriminating means for discriminating each cylinder of said engine on the basis of number of said pulses of said crank angle means and presence of said cam signal.

The above and other objects, features and advantages of the present invention will become more apparent from the following detailed description which is to be read in conjunction with the accompanying drawings.

BRIEF DESCRIPTION OF THE DRAWINGS

FIG. 11 is a view showing signal logic used for cylinder discrimination in accordance with the first embodiment;

FIG. 17 is a view showing signal logic used for cylinder discrimination in accordance with the second embodiment;

DETAILED DESCRIPTION OF THE PREFERRED EMBODIMENTS

Hereinafter, with reference to accompanying drawings, preferred embodiments of the present invention will be explained in detail.

FIRST EMBODIMENT

Figure 1:
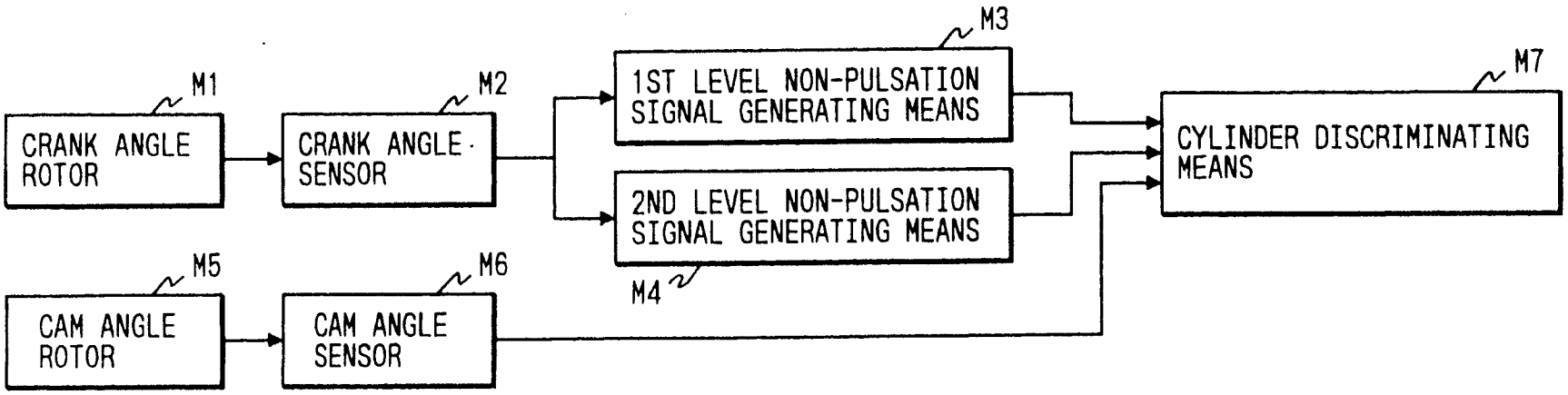
FIG. 1 is a schematic block diagram showing a first embodiment of the present invention.
Figure 2:
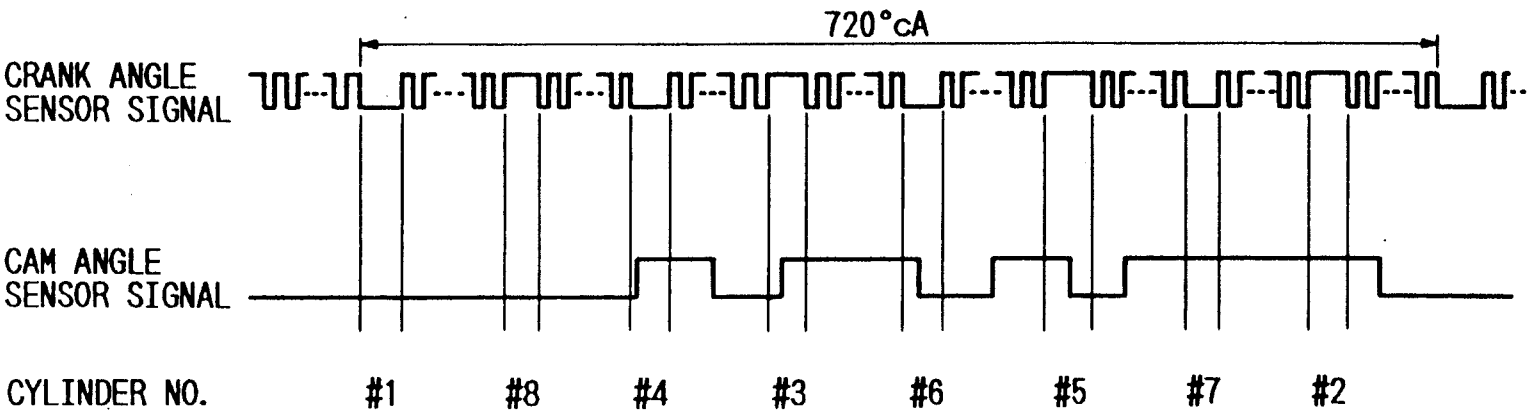
FIG. 2 is a time chart showing sensor signals used in the first embodiment of FIG. 1.
Figure 3:
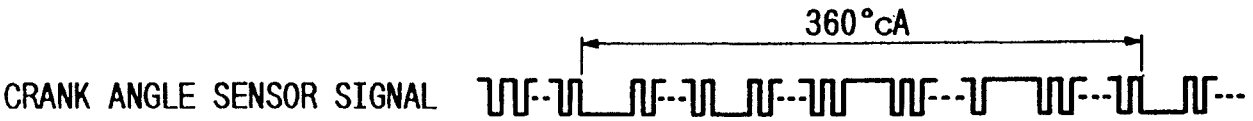
FIG. 3 is a time chart showing a sensor signal used in the first embodiment of FIG. 1.
Figure 4:
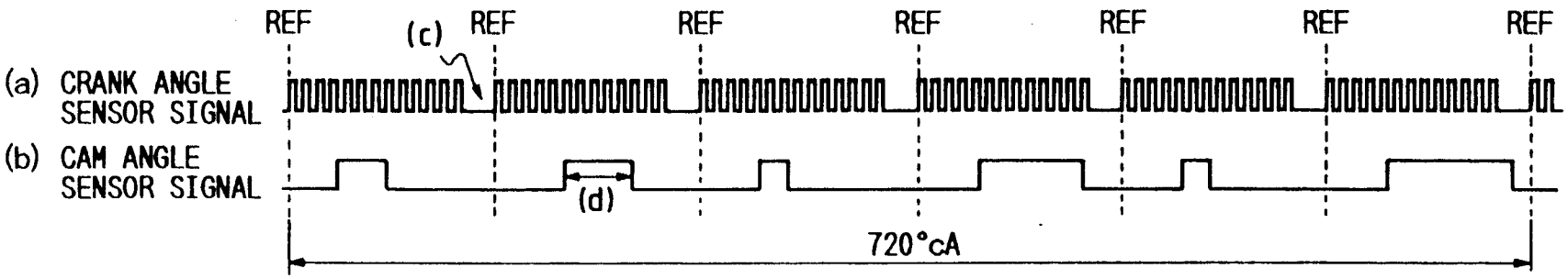
FIG. 4 PRIOR ART
FIG. 4 is a time chart showing sensor signals used in the prior art.
Figure 5:
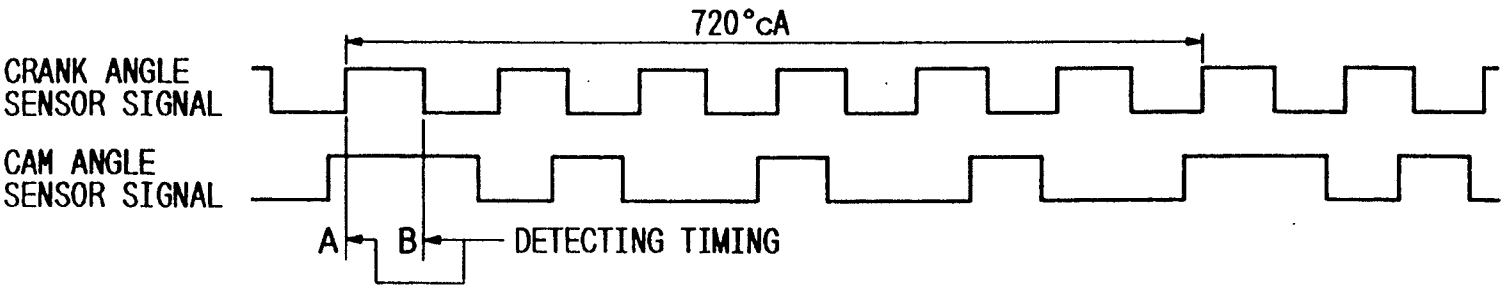
FIG. 5 PRIOR ART
FIG. 5 is a time chart showing another sensor signals used in the prior art.
Figures 6, 7:
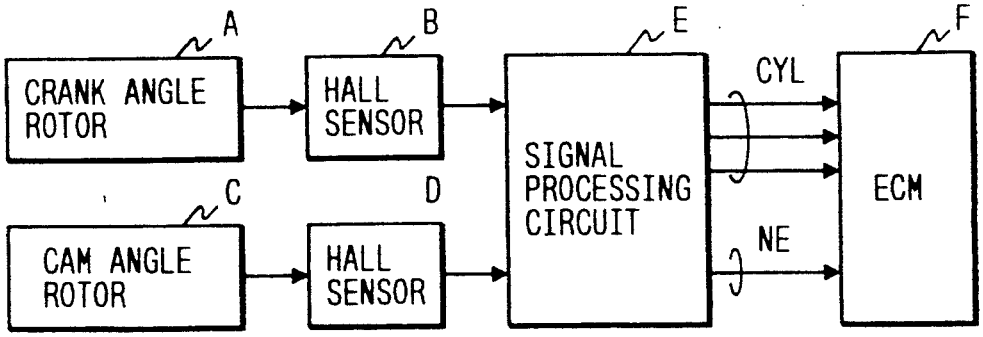
FIG. 6 PRIOR ART
FIG. 6 is a view showing signal logic used for cylinder discrimination in the prior art.
FIG. 7 is a block diagram showing the first embodiment of the present invention.

FIG. 7 is a circuit block diagram showing a circuit configuration of a first embodiment of the present invention. A reference character A represents a crank angle rotor, which is provided for detecting a crank angle of an engine. The crank angle rotor is fixed to a crank shaft of the engine so as to rotate integrally together with the crank shaft. A reference character B represents a Hall sensor serving as a crank angle sensor which is cooperative with the crank angle rotor to detect a crank angle of the engine. A reference character C represents a cam angle rotor, which is provided for detecting a cam angle of the engine. The cam angle rotor C is fixed to a cam shaft of the engine so as to rotate integrally together with the crank shaft. The cam shaft rotates at a half speed of the crank shaft. A reference character D represents another Hall sensor serving as a cam angle sensor which is cooperative with the cam angle rotor C to detect a cam angle of the engine.

A reference character E represents a signal processing circuit, which receives signals outputted from the Hall sensors B, D and generates an angle signal NE and cylinder discrimination signals CYL on the basis of the signals detected by the Hall sensors B, D. And, a reference character F represents an engine controller (abbreviated as ECM), which performs ignition and/or fuel controls on the basis of various information.

Figure 8:
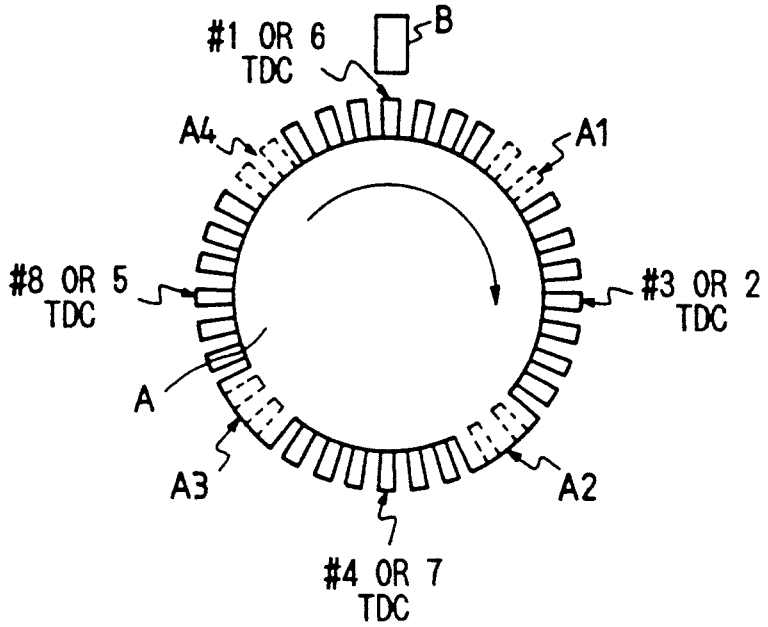
FIG. 8 is a view showing a crank angle rotor used in the first embodiment.

FIG. 8 shows a detailed configuration of the crank angle rotor A. This crank angle rotor A has numerous projections and recessions alternately disposed at a circumferential peripheral portion thereof. Each of the projections and recessions has a width of 5° CA. These projections and recessions are operatively associated with the crank angle sensor B for generating a crank angle signal of pulsation waveform.

In FIG. 8, two sections generally denoted by reference characters A1 and A4 are silent sections which are not provided with projections; therefore, they cause LOW-level non-pulsation components of the crank angle signal. Another two sections generally denoted by reference characters A2, A3 are another silent sections which are not provided with recessions; therefore, they cause HIGH-level non-pulsation components of the crank angle signal. Namely, total of four silent sections A1, A2, A3, and A4 are provided on the circumferential peripheral portion of the crank angle rotor A in this order in a clockwise direction. Two (i.e. A1 and A4) of them constitute one group of LOW-level non-pulsation signal components. The other two (i.e. A2 and A3) of them constitute the other group of HIGH-level non-pulsation signal components.

The silent section A1 is used to detect a reference point corresponding to a BTDC (i.e. before top dead center) 30° CA for a #3 or #2 cylinder. Likewise, the silent section A2 is used to detect another reference point corresponding to a BTDC 30° CA for a #4 or #7 cylinder. The silent section A3 is used to detect still another reference point corresponding to a BTDC 30° CA for a #8 or #5 cylinder. And, the silent section A4 is used to detect yet another reference point corresponding to a BTDC 30° CA for a #1 or #6 cylinder.

Namely, the circumferential peripheral portion of the crank angle rotor A is formed with two kinds of a plurality of silent sections for generating non-pulsation signal components. One group of the silent sections generates a predetermined first level signal components, and the other group of the silent sections generates a predetermined second level signal components. The silent sections belonging to the one group are provided the same number as the silent sections belonging to the other group. Total number of the silent sections is half of cylinders of the engine.

Furthermore, the silent sections of the crank angle rotor are disposed in such a manner that consecutive two sections belonging to the one group are followed by consecutive two sections belonging to the other group.

Figure 9:
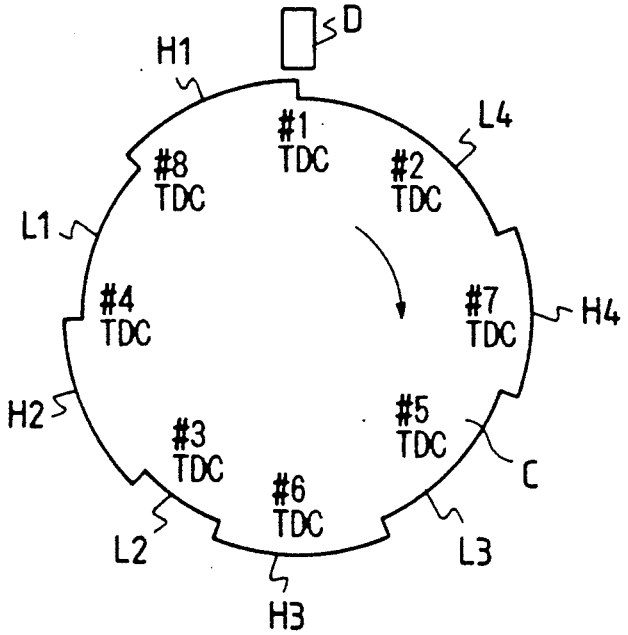
FIG. 9 is a view showing a cam angle rotor used in the first embodiment.

FIG. 9 shows a detailed configuration of the cam angle rotor C. This cam angle rotor C has also plurality of projections and recessions alternately disposed at a circumferential peripheral portion thereof. These projections and recessions provide two level signals. In more detail, a projection H1 of 45° CA, a recession L1 of 45° CA, a projection H2 of 45° CA, a recession L2 of 22.5° CA, a projection H3 of 45° CA, a recession L3 of 45° CA, a projection H4 of 45° CA, and a recession L4 of 67.5° CA are successively provided on the circumferential peripheral portion of the cam angle rotor C in a counterclockwise direction.

Reference points corresponding to BTDC 30° CA for #1, #8, #4, #3, #6, #5, #7, #2, and #1, successively disposed in this order in a counterclockwise direction, are indicated together in the drawing.

Namely, the cam angle rotor detecting a cam angle of the engine has a predetermined number of projections and recessions at a circumferential peripheral portion thereof, so as to provide two level signals. The projections and recessions of the cam angle rotor are made not uniform in their widths in order to provide a plurality of different kinds of signal level sequences such as H-H, H-L, L-H, and L-L, with respect to the corresponding silent sections of the crank angle rotor.

Figure 10:
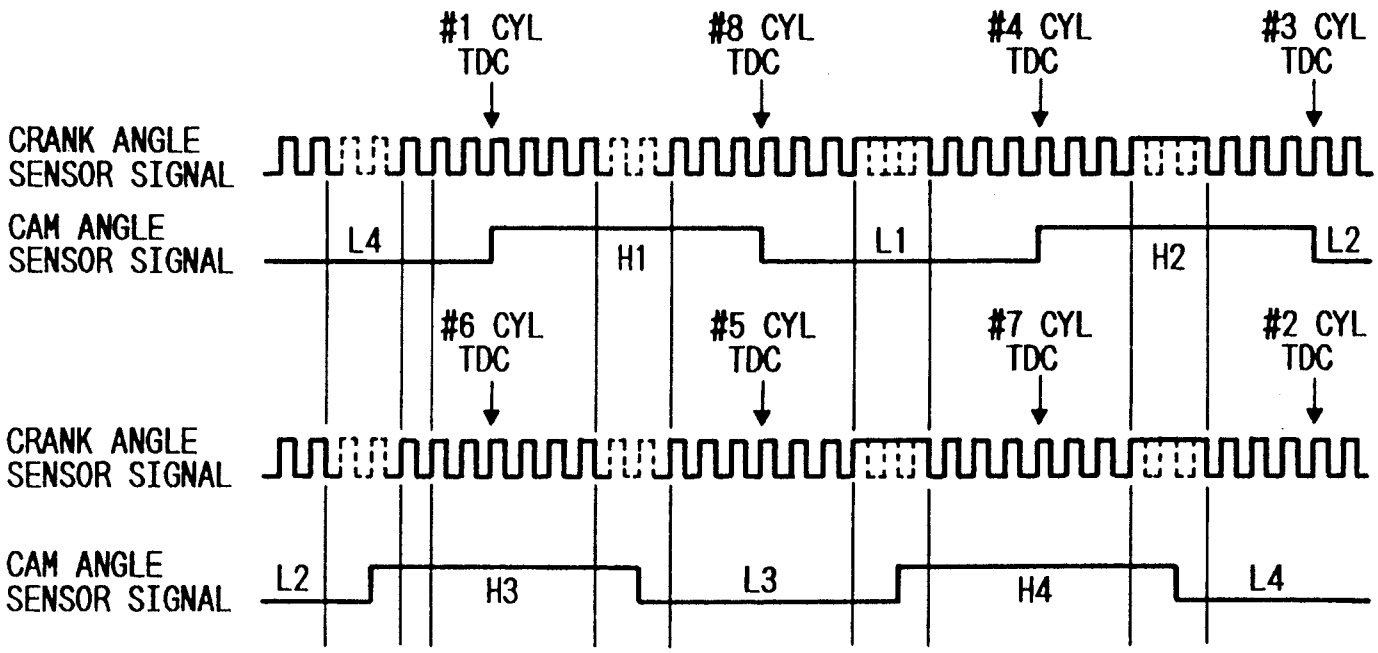
FIG. 10 is a time chart showing sensor signals used in the first embodiment.

FIG. 10 shows a timing chart of the crank angle sensor signal and the cam angle sensor signal. The above-mentioned signal sequences of H-H. H-L, L-H, and L-L, are defined by a combination of signal levels (i.e. G1, G2 of FIG. 11) of the cam angle sensor signal measured at timings corresponding to both rise and drop edges of the silent (i.e. non-pulsation) section of the crank angle sensor signal.

FIG. 11 summarizes the data required for discriminating #1–#8 cylinders. As described above, the silent (i.e. non-pulsation) section of the crank angle rotor itself generates either a HIGH or a LOW level component. Meanwhile, the cam angle rotor generates either one of signal sequences H-H, H-L, L-H, and L-L. This variation derived from the crank angle rotor and the cam angle rotor provides eight different combinations at best, which just suits for identifying each cylinder of the 8-cylinder engine. Accordingly, #1 to #8 cylinders are specified by the combination of these data obtained from the crank angle rotor and the cam angle rotor as shown in FIG. 11. In other words, a cylinder discrimination for discriminating each of cylinders of the engine is carried out on the basis of the signal level (N1) of the silent or non-pulsation section of the crank angle rotor and the signal level sequence (G1, G2) of the cam angle rotor. A value of a port output, i.e. the cylinder discrimination signal CYL, is determined in accordance with the cylinder number (#1, #2, - - - , #8), as shown in the bottom of FIG. 11. For example, when the #3 cylinder is identified, a port output of "3" is supplied from the signal processing circuit E to the ECM F through three signal lines after the value "3" is binary coded into "011".

Figure 12:
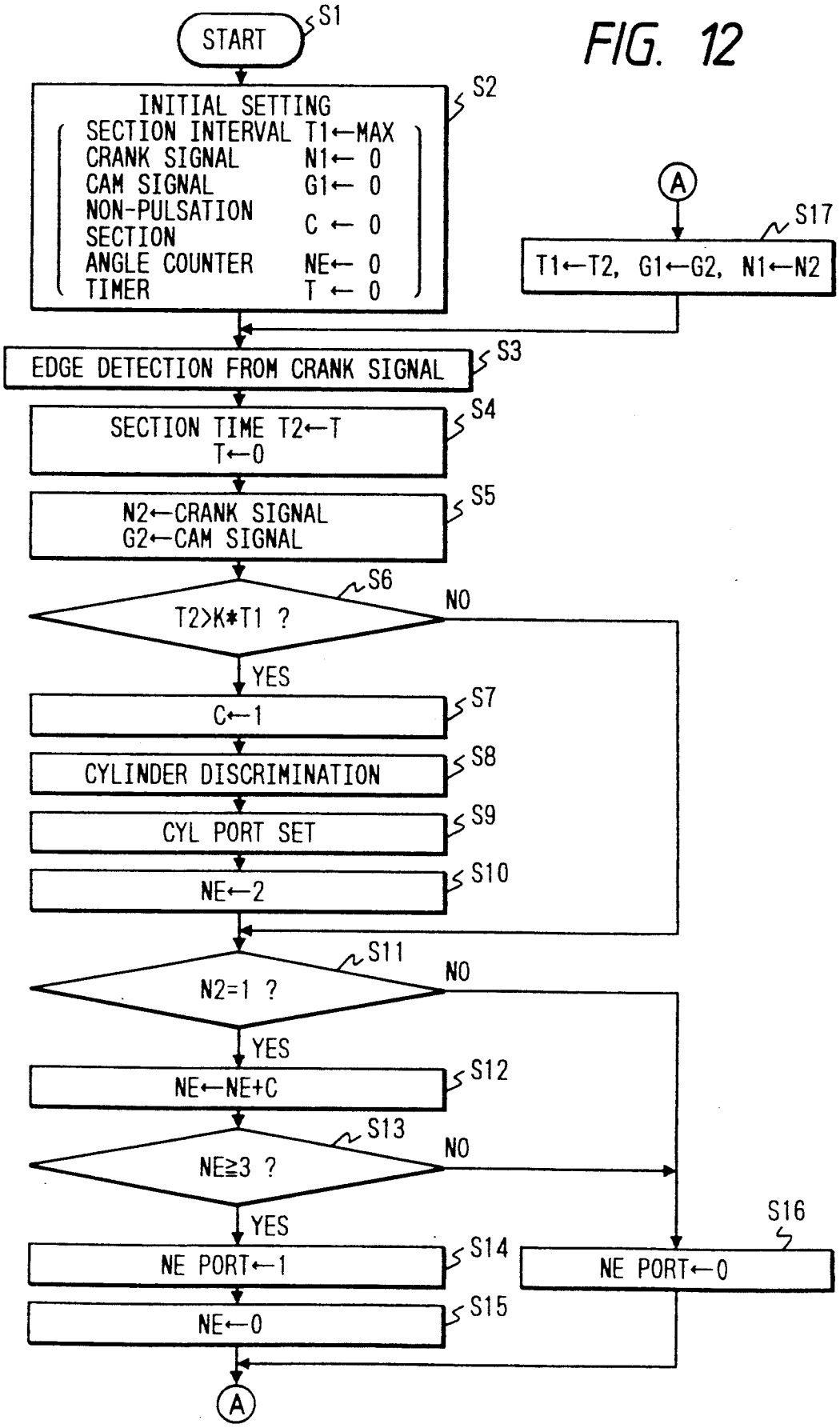
FIG. 12 is a flowchart showing a cylinder discrimination procedure in accordance with the first embodiment.

FIG. 12 is a flowchart showing an ordinary control procedure performed in the signal processing circuit E (hereinafter, referred to as SPC). After initiating this routine in a step S1, the SPC proceeds to a step S2 to set initial values to various parameters. In more detail, a section interval T1 is set to its maximum value. A crank signal flag N1, a cam signal flag G1, a non-pulsation section counter C, an angle counter NE, and a timer T are respectively reset to "0" in this step S2. Then, the SPC proceeds to a step S3 to detect an edge, i.e. a rise or drop edge, of the crank angle sensor signal A. Subsequently, the SPC proceeds to a step S4 to detect a section time T2. Namely, a time interval from a previously detected edge to the presently detected edge in the step S3 is measured by the timer T. Therefore, a value of the timer T is memorized as the section time T2. Then, the timer is again reset to "0".

Next, the SPC proceeds to a step S5 to memorize the level of the crank angle sensor signal detected immediately after the edge is detected in the step S3. And, this level is memorized as a crank signal flag N2. If the detected crank angle signal is HIGH-level, the crank signal flag N2 is set to "1". On the contrary, if the detected crank angle signal is LOW-level, the crank signal flag N2 is reset to "0". Furthermore, the SPC detects and memorizes a cam angle sensor signal as a cam signal flag G2 in the step S5. Namely, if the detected cam angle sensor signal is HIGH-level at the timing of the detection of the edge in the step S3, the cam signal flag G2 is set to "1". If the detected cam angle sensor signal is LOW-level at the timing of the detection of the edge in the step S3, the cam signal flag G2 is set to "0".

The SPC subsequently proceeds to a step S6 to check if the present section is a non-pulsation section. The step S6 accordingly makes a judgement as to whether or not T2 is larger than K*T1, where K being a constant approximating 3. It is needless to say that the constant K should be determined by taking account of the length of the silent section (i.e. non-pulsation section) of the crank angle rotor A. As the section interval T1 is set to the maximum value in the initial setting of the step S2, the judgement in the step S6 becomes NO in the first execution of this routine and, therefore, the SPC directly proceeds to a step S11.

If the judgement of the step S6 becomes YES in a later procedure, the SPC concludes that the present section is a non-pulsation section and, then, proceeds to a step S7 to set the non-pulsation section counter C to "1".

Thereafter, the SPC proceeds to a step S8 to perform a cylinder discrimination in accordance with the present embodiment. As the data N1, G1, and G2 are all known at this moment, the SPC can discriminate the cylinder with reference to the table of FIG. 11. Then, the SPC proceeds to a step S9 to output a discrimination result from the CYL port. After that, the SPC proceeds to a step S10 to set the angle counter NE to "2".

Subsequently, the SPC proceeds to the step S11 to make a judgement as to whether or not the data N2 is identical with "1". If the judgement is YES in the step S11, the SPC proceeds to a step S12 to increment the angle counter NE by a value of the counter C. Then, the SPC proceeds to a step S13 to further make a judgement as to whether or not the angle counter NE is equal to or more than 3. If the judgement is YES, the SPC proceeds to a step S14 to set the NE port to "1" and thereafter proceeds to a step S15 to reset the angle counter NE to "0". If the judgement is NO in the step S13, the SPC proceeds to a step S16 to set the NE port to "0". That is, the SPC generates the port output every three pulses of the crank angle sensor (equivalent to 30° CA) through the steps S11–S16.

Finally, the SPC proceeds to a step S17 to renew the data T1, G1, and N2 by T2, G2, and N2, respectively, and thereafter returns to the step S3 to repeat the procedure defined by the steps S4–S17.

Figures 13, 14:
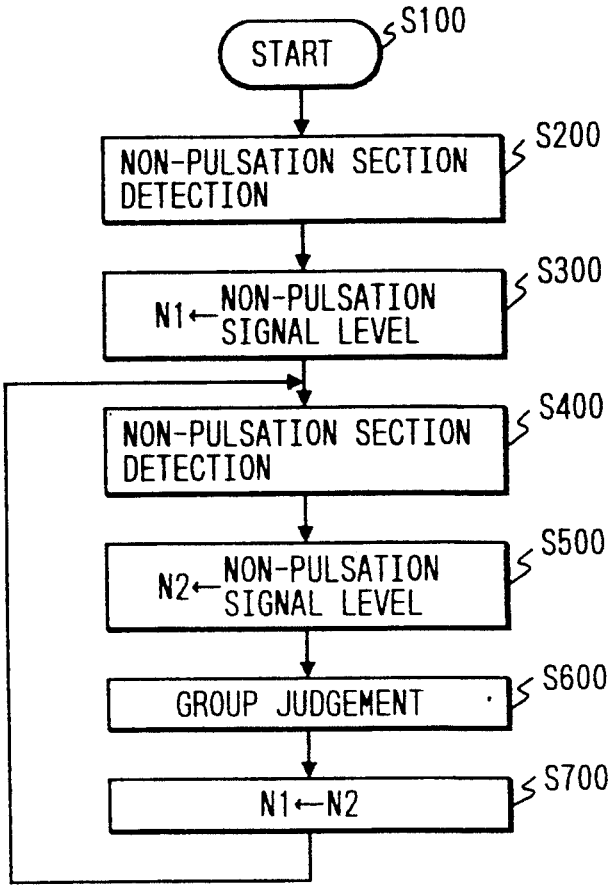
FIG. 13 is a flowchart showing another cylinder discrimination procedure in accordance with the first embodiment.
FIG. 14 is a view showing signal logic used for cylinder discrimination in accordance with the first embodiment.

Next, let us suppose that the cam angle sensor D is functionally disabled. In such a case, the present embodiment allows the engine controller ECM to drive the engine without no interruption. For such an emergency operation of the engine, a special method of discriminating cylinders is used. FIG. 13 is a flowchart showing an emergency control procedure. After starting this routine at a step S100, the SPC proceeds to a step S200 to perform a non-pulsation section detection and thereafter proceeds to a step S300 to detect a level (N1) of the non-pulsation signal level. Contents of these two steps S200 and S300 are substantially the same as above-described procedure of FIG. 12, and therefore will no further be explained.

Next, the SPC proceeds to a step S400 to perform the next non-pulsation section detection and then proceeds to a step S500 to detect a level (N2) of the non-pulsation signal level detected in the step S400. Subsequently, the SPC proceeds to a step S600 to make a discrimination of cylinder group. FIG. 14 shows combination of levels N1, N2 in connection with the corresponding cylinder groups. Namely, as explained in the foregoing description, the silent (i.e. non-pulsation) sections A1, A2, A3, and A4 of the crank angle rotor A are disposed in such a manner that consecutive two sections belonging to the one group (i.e. having a first level) are followed by consecutive two sections belonging to the other group (i.e. having a second level). For example, as apparent from FIG. 8, A TDC of the #1 or #6 cylinders comes after non-pulsation sections A3, A4. Signal levels (N1, N2) of these non-pulsation sections A3, A4 are (H, L). This agrees with the content of the table shown in FIG. 14.

Accordingly, the cylinder group can be surely discriminated by the combination or sequence of signal levels of the consecutive two non-pulsation sections. In other words, this embodiment makes it possible to discriminate cylinder groups by solely using the crank angle sensor in the case where no cam angle signal is available.

After completing the cylinder group judgement, the SPC proceeds to a step S700 to renew the value of N1 by the value of N2 and then returns to the step S400 to repeat the same procedure of the steps S400 to S700.

Consequently, the present embodiment enables a driver to drive the engine safely in an emergency condition where the cam angle sensor is disabled.

SECOND EMBODIMENT

Figure 15:
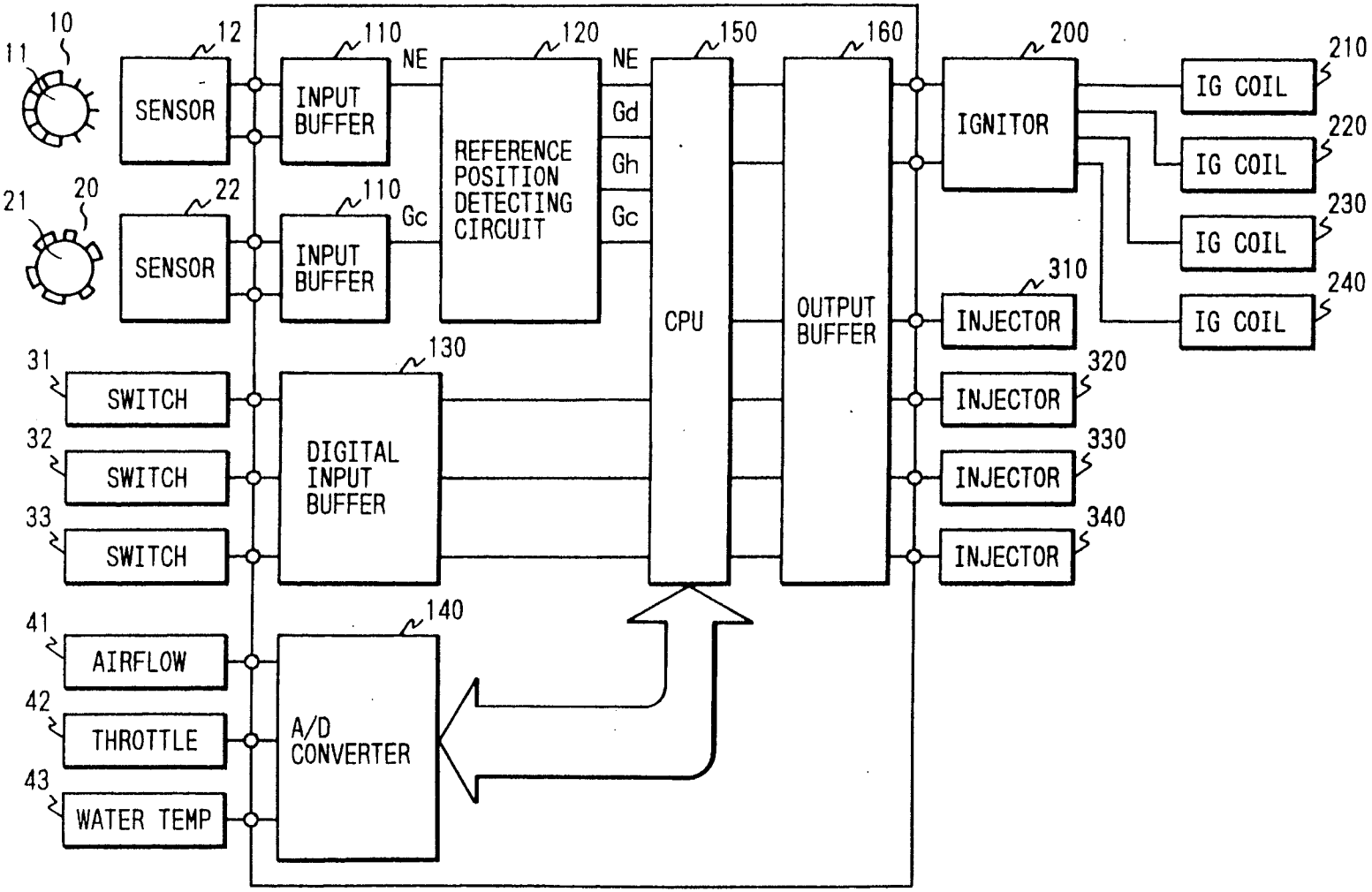
FIG. 15 is a block diagram showing the second embodiment of the present invention.

FIG. 15 is a block diagram showing a circuit configuration of an engine control apparatus in accordance with a second embodiment. In the drawing, a reference numeral 10 represents a crank angle detector, which detects a rotational angle of a crank shaft of an internal combustion engine. The crank angle detector 10 consists of a crank angle rotor 11 and a crank angle sensor 12.

The crank angle rotor 11, integrally fixed to the crank shaft, has numerous projections and recessions alternately disposed at a circumferential peripheral portion thereof. The crank angle sensor 12, being generally a photoelectric type or a Hall IC type, is operatively associated with these alternate projections and recessions for generating a rotational angle signal of pulsation waveform including two, i.e. HIGH and LOW, signal level components.

A reference numeral 20 represents a cam angle detector, which serves as a cylinder discrimination signal generator. The cam angle detector 20 consists of a cam angle rotor 21 and a cylinder discrimination sensor 22.

The cam angle rotor 21 is entrained with the crank angle rotor 11 by a timing belt or a chain, and rotated at a rotational speed ratio of 1:2. The cam angle rotor 21 is therefore a half-speed rotor which rotates at a half speed of the crank angle rotor 11. The circumferential peripheral portion of the cam angle rotor 21 is formed with a plurality of projections whose widths are not uniform. The number of the projections are the same as the number of cylinders of the internal combustion engine.

The cylinder discrimination sensor 22, being generally a photoelectric type or a Hall IC type, is associated with the cam angle rotor 21 so as to generate a cylinder discrimination signal of pulsation waveform. The cylinder discrimination signal therefore includes a plurality of different kinds of pulses corresponding to the projections of the cam angle rotor 21. The number of the pulses is the same as the number of the cylinders.

As the second embodiment is based on a 6-cylinder engine, the cylinder discrimination sensor 22 generates six pulses as the cylinder discrimination signal per two complete revolutions of the crank shaft.

Output signals, i.e. the rotational angle signal and the cylinder discrimination signals, of the crank angle sensor 12 and the cylinder discrimination sensor 22 are supplied through input buffers 110, 110 to a reference position detecting circuit 120. Although this reference position detecting circuit 120 is illustrated independently of a CPU 150 (central processing unit) in FIG. 15. It is needless to say that the reference position detecting circuit 120 would be omitted if the CPU 150 has a function equivalent to the reference position detecting circuit 120.

Figure 16:
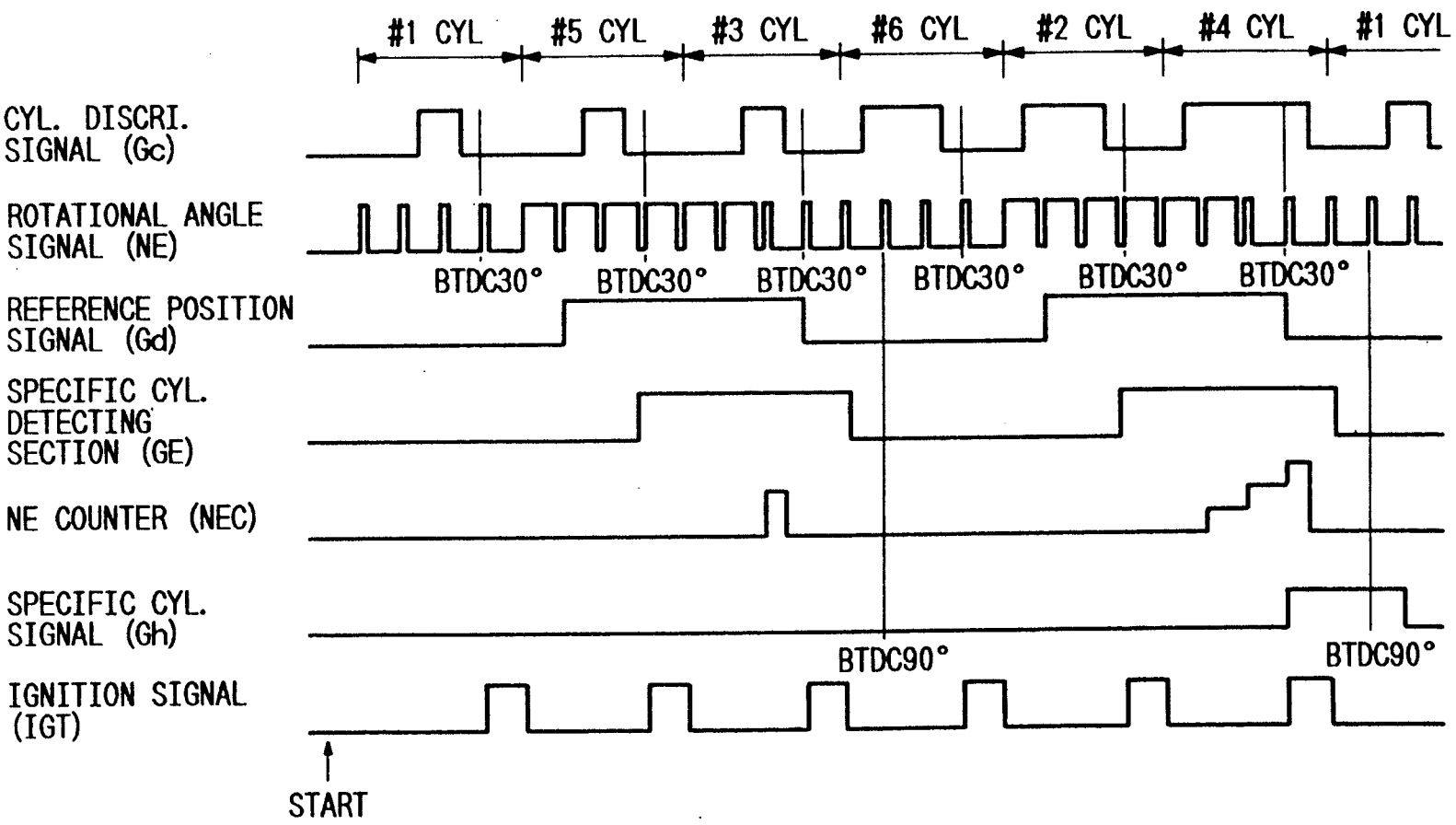
FIG. 16 is a time chart showing sensor signals used in the second embodiment.

The reference position detecting circuit 120 receives the rotational angle signal NE from the crank angle sensor 12 and the cylinder discrimination signal Gc from the cylinder discrimination sensor 22, as shown in FIG. 16. The reference position detecting circuit 120 generates a reference position signal Gd, a specific cylinder detecting section signal GE, an NE counter signal NEC, and a special cylinder signal Gh on the basis of the rotational angle signal NE and the cylinder discrimination signal Gc. Details of the formation of these signals Gd, GE, NEC, and Gh will be explained later. Then, these signals are supplied to the CPU 150.

The CPU 150 performs various calculations for detecting cylinders, reference positions, rotational speeds and others. The CPU 150 also receives operational condition signals through a digital input buffer 130 from switches 31-33. Such switches normally include a starter switch detecting a starting condition of the engine, and an idle switch detecting an idle condition of the engine. Furthermore, the CPU 150 receives another operational condition signals through an A/D converter 140 from several sensors. Such sensors usually include an airflow meter 41 for detecting an airflow amount introduced into the engine, a throttle sensor 42 for detecting a throttle opening degree, and a water temperature sensor 43 for detecting a cooling water temperature of the engine. The CPU 160 obtains optimum ignition timing and fuel injection amount/timing on the basis of the data obtained from various switches 31-33 and sensors 41-43 as well as NE, Gd, Gh, Gc signals from the reference position detecting circuit 120.

The CPU 150 outputs ignition control signals through an output buffer 160 to an ignitor 200. The ignitor 200 actuates any one of ignition (IG) coils 210, 220, 230, and 240 in response to the ignition control signal. In the same manner, the CPU 150 outputs the fuel injection control signal through the output buffer 160 to any one of fuel injectors 310, 320, 330, and 340. Although four IG coils 210–240 and four injectors 310–340 are illustrated in the drawing, these numbers are not related to the actual number of IG coils and injectors of the 6-cylinder engine of this second embodiment.

Next, waveforms of various signals will be explained in more detail with reference to FIG. 16. The rotational angle signal NE has a waveform consisting of first and second sections alternately repeated at an interval of 180° CA. The first section is 6 times alternate 5° CA HIGH-level and 25° CA LOW-level section. The second section, following the first section, is 6 times alternate 25° CA HIGH-level and 5° CA LOW-level section.

The cylinder discrimination signal Gc is outputted every 120° CA as this embodiment is based on the 6-cylinder engine. The pulse width (i.e. HIGH-level portion) of the cylinder discrimination signal Gc is set to be approximately 30° CA with respect to #1, #5, and #3 cylinders, approximately 60° CA to #6 and #2 cylinders, and approximately 90° CA to #4 cylinder.

The reference position signal Gd is formed by detecting change of duty widths of the HIGH-level portion and LOW-level portion of the rotational angle signal NE. This detection will be later explained in detail with reference to a flowchart of FIG. 19.

The specific cylinder detecting section signal GE is formed by delaying the reference position signal Gd by a predetermined amount. The formation of the specific cylinder detecting section signal GE will be later explained in detail with reference to FIG. 20.

The NE counter NEC counts rising pulses of the rotational angle signal NE during a period of time when the cylinder discrimination signal Gc and the specific cylinder detecting section signal GE are both HIGH-level. Details will be later explained with reference to FIG. 21.

Furthermore, the specific cylinder signal Gh is formed by making a judgement as to whether or not the NE counter NEC exceeds a predetermined value (e.g. "3" in this embodiment).

The waveform illustrated in the bottom of FIG. 16 is the ignition control signal IGT supplied from the CPU 150 to the ignitor 200.

FIG. 17 shows a signal logic, i.e. a principle, for discriminating cylinders of an engine in accordance with the second embodiment. For the discrimination of cylinders, this second embodiment requires three different data. First data is a signal level of the rotational angle signal NE at the time when the cylinder discriminating signal Gc rises from LOW-level to HIGH-level. Second data is a signal level of the rotational angle signal NE at the time when the cylinder discriminating signal Gc drops from HIGH-level to LOW-level. And, third data is the number indicating how many times the pulse of the rotational angle signal NE has risen during a time period when the cylinder discriminating signal Gc is HIGH-level, i.e. between the rise and drop of the cylinder discriminating signal Gc. These three different data provide six different signal combinations so as to suit for the discrimination of 6 cylinders #1–#6.

The projections of the cam angle rotor 21 are precisely designed their locations in order to provide and assure the signal logic of FIG. 17. The rise timing of each pulse of the cylinder discriminating signal Gc is determined so as to satisfy the signal logic of FIG. 17.

In other words, the projections and recessions of the crank angle rotor 11 are disposed to provide four different kinds of signal level sequences of Hi-Hi, Hi-Lo, Lo-Hi, and Lo-Lo with respect to the rise and drop edges of respective pulses of the cylinder discrimination signal Gc and also to provide different number of pulse rise edges of the crank angle signal NE between the rise and drop pulse edges of the cylinder discrimination signal Gc.

In FIG. 17, #4 cylinder can be discriminated by merely knowing the third data. All data necessary for discriminating the #4 cylinder is the count number of how many times the pulse of the rotational angle signal NE has risen during a time period when the cylinder discriminating signal Gc is HIGH-level. Therefore, the cylinder discriminating judgement for the #4 cylinder can be accomplished as soon as the third data becomes "3", without waiting the detection of the second data. Waiting the second data will result in a waste of time. Because the second data, i.e. the signal level of the rotational angle signal NE at the time when the cylinder discriminating signal Gc drops from HIGH-level to LOW-level, is detected last. The present embodiment skips the detection of the second data; therefore, it will be effective to promptly accomplish the cylinder discriminating judgement.

Figure 18:
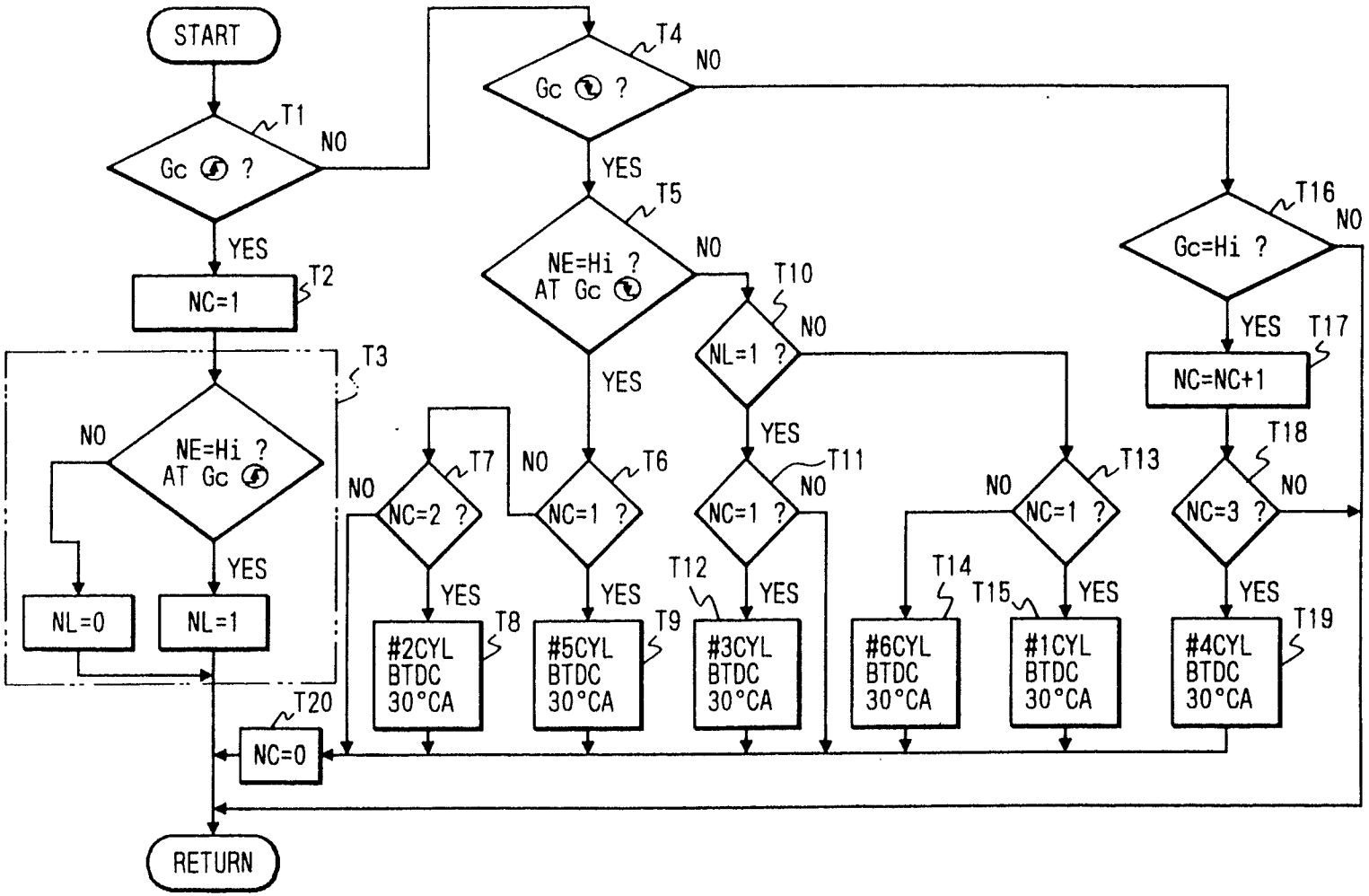
FIG. 18 is a flowchart showing a cylinder discrimination procedure in accordance with the second embodiment.

FIG. 18 is a flowchart showing the cylinder discrimination procedure performed in the CPU 150. This procedure is executed until the special cylinder signal Gh is detected.

First of all, the CPU 150 proceeds to a step T1 to make a judgement as to whether or not the Gc signal rises. If the Gc signal rises in the step T1, the CPU 150 proceeds to a step T2 to set a count CN to 1. This counter CN counts how many times the NE signal has risen when the Gc signal is HIGH-level. Then, the CPU 150 proceeds to a step T3 to memorize the signal level of the NE signal when the Gc signal just rises. Namely, if the NE signal is HIGH, a flag NL is set to "1". On the contrary, if the NE signal is LOW, the flag NL is set to "0".

Returning to the step T1, if the judgement is NO, the CPU 150 proceeds to a step T4 to make a judgement as to whether or not the Gc signal drops. If the Gc signal drops in the step T4, the CPU 150 proceeds to a step T5 to further make a judgement as to whether or not the NE signal is HIGH at the time when the Gc signal just drops. If the NE signal is HIGH in the step T5, the CPU 150 proceeds to a step T6 to make a judgement as to whether or not the counter NC is identical with "1". If the counter NC is "1", the CPU 150 proceeds to a step T9. That is, the CPU 150 concludes that the present NE timing corresponds to BTDC 30° CA of #5 cylinder with reference to the signal logic of FIG. 17.

If the counter NC is not identical with "1" in the step T6, the CPU 150 proceeds to a step T7 to make a judgement as to whether or not the counter NC is identical with "2". If the counter NC is "2", the CPU 150 proceeds to a step T8 to conclude that the present NE timing corresponds to BTDC 30° CA of #2 cylinder with reference to the signal logic of FIG. 17. If the judgement in the step T7 is NO, the CPU 150 proceeds to a step T20 without discrimination of cylinders.

Returning to the step T5, if the NE signal is LOW, the CPU 150 proceeds to a step T10. It is concluded at this moment that the present NE timing corresponds to any one of #1, #3, #4, and #6 cylinders from the signal logic of FIG. 17. The CPU 150 makes a judgement in the step T10 as to whether or not the flag NL is "1". If the NE signal was HIGH-level at the time when the Gc signal just rises, the judgement in the step T10 becomes YES. Then, the CPU 150 proceeds to a step T11 to make a judgement as to whether or not the NC count is identical with "1". If the NC count is "1", the CPU 150 proceeds to a step T12 to conclude that the present NE timing corresponds to BTDC 30° CA of #3 cylinder with reference to the signal logic of FIG. 17. If the judgement in the step T11 is NO, the CPU 150 proceeds to the step T20 without discriminating cylinders.

Returning to the step T10, if the NL flag is not "1", the CPU 150 proceeds to a step T13 to make a judgement as to whether or not the NC count is identical with "1". If the NC count is "1", the CPU 150 proceeds to a step T15 to conclude that the present NE timing corresponds to BTDC 30° CA of #1 cylinder with reference to the signal logic of FIG. 17. And, if the NC count is not identical with "1" in the step T13, the CPU 150 proceeds to a step T14 to conclude that the present NE timing corresponds to BTDC 30° CA of #6 cylinder with reference to the signal logic of FIG. 17.

Furthermore, returning to the step T4, if the judgement is NO, the CPU 150 proceeds to a step T16 to make a judgement as to whether or not the level of the Gc signal is HIGH-level. If the Gc signal is HIGH-level, the CPU 150 proceeds to a step T17 to increment the NC count. Thereafter, the CPU 150 proceeds to a step T18 to make a judgement as to whether or not the NC count is identical with "3". If the NC count is "3", the CPU 150 proceeds to a step T19 to conclude that the present NE timing corresponds to BTDC 30° CA of #4 cylinder with reference to the signal logic of FIG. 17. Namely, the #4 cylinder can be discriminated immediately after the NC count becomes "3" without waiting the judgement of the NE signal level at the drop timing of the Gc signal, as explained in the foregoing description.

As explained in the foregoing description, the CPU 150 serves as a cylinder discriminating means for discriminating each of #1–#6 cylinders of the 6-cylinder engine on the basis of the signal level sequences and the number of pulse edges listed in FIG. 17.

Let us now suppose that the cam shaft and the crank shaft are mutually displaced due to mechanical play or something to cause a significant amount of phase deviation. If this phase deviation is too much, the signal logic of FIG. 17 would be deteriorated, resulting in the failure of the cylinder discrimination. For example, the Gc pulse corresponding to #6 cylinder may encompass three pulse rises of the NE signal.

The present embodiment therefore provides an auxiliary cylinder detection separately performed in order to ensure the cylinder discrimination. Characteristic feature of this auxiliary cylinder discrimination is detecting a specific cylinder. To detect the specific cylinder, the reference position signal Gd, the specific cylinder detecting section signal GE, and the NE counter NEC need to be obtained.

Figure 19:
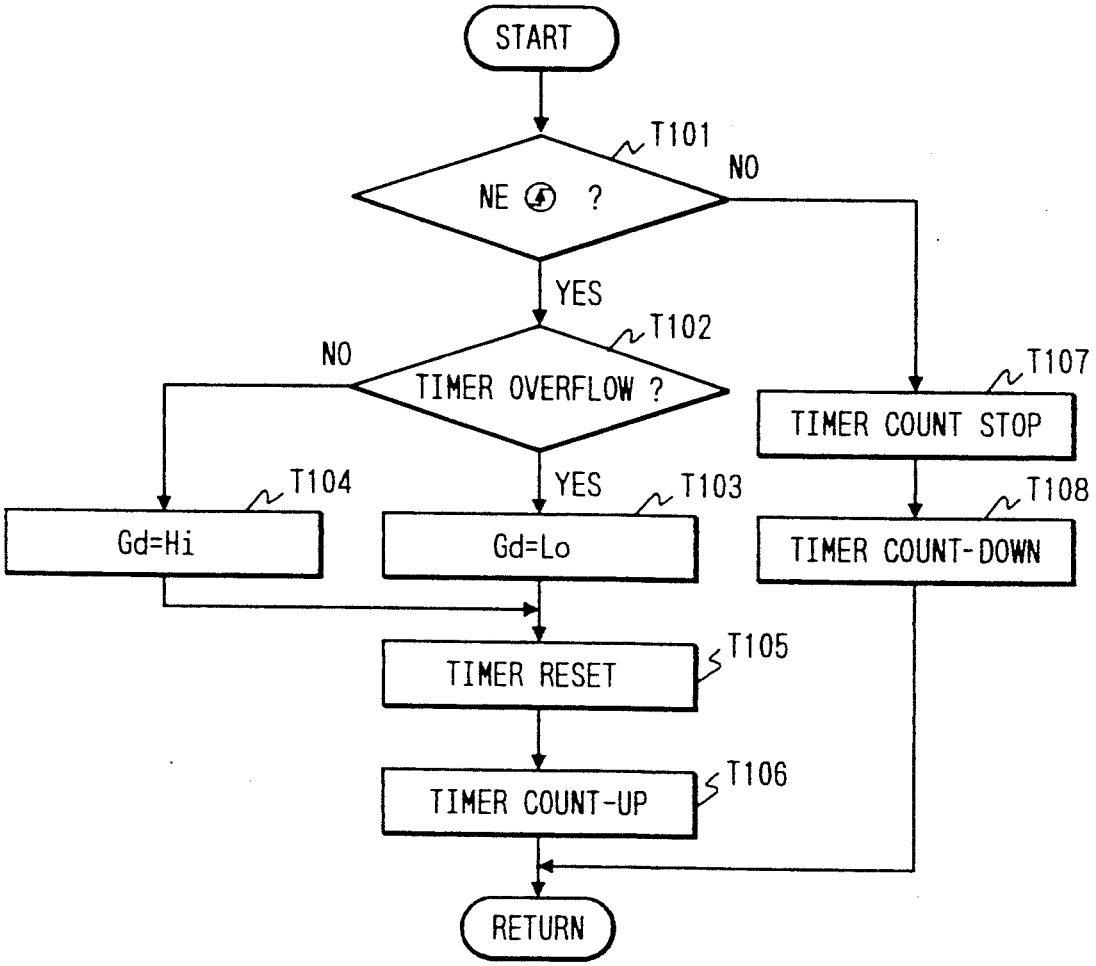
FIG. 19 is a flowchart showing a procedure for forming a reference position signal in accordance with the second embodiment.

FIG. 19 is a flowchart showing the method of forming the reference position signal Gd. This routine is an interrupt subroutine executed by the reference position detecting circuit 120 (hereinafter abbreviated as RPD) every time the NE signal causes a rise or a drop. The RPD 120 makes a judgement in a step T101 as to whether or not the NE signal causes a rise. If the NE signal causes a rise, the RPD 120 proceeds to a step T102 to make a judgement as to whether or not a timer overflows. Here, the word "overflow" means that a value of the timer decreases below "0". If the judgement is YES in the step T102, the RPD 120 proceeds to a step T103 to set the signal Gd to LOW. On the other hand, if the judgement is NO in the step T102, the RPD 120 proceeds to a step T104 to set the signal Gd to HIGH. The reason of this judgement will be described later. Then, the RPD 120 proceeds to a step T105 to reset the timer to "0" and, subsequently, proceeds to a step T106 to initiates a count-up of the timer.

Meanwhile, if the NE signal causes a drop in the step T101, the RPD 120 proceeds to a step T107 to terminate the timer count and, thereafter, proceeds to a step T108 to initiate a count-down of the timer.

As already explained with reference to FIG. 16, the NE signal has a waveform consisting of first and second sections alternately repeated at regular intervals of 180° CA. The first section is 6 times alternate 5° CA HIGH-level and 25° CA LOW-level section. The second section, following the first section, is 6 times alternate 25° CA HIGH-level and 5° CA LOW-level section.

Now let us suppose that the present NE detecting timing is in the first section. In this case, the LOW-level portion of the NE signal is longer than the HIGH-level portion of the NE signal. This means that the value being counted down becomes larger than the value being counted up in the timer. Therefore, the timer overflows in the step T102 and hence the Gd signal is determined as LOW-level in the step T103. On the contrary, if the present NE detecting timing is in the second section, the HIGH-level portion of the NE signal is longer than the LOW-level portion of the NE signal. Thus, the value being counted up becomes larger than the value being counted down in the timer. Accordingly, the timer does not overflow in the step T102 and therefore the Gd signal is determined as HIGH-level in the step T103. As a result of above procedure, the waveform of the reference position signal Gd is obtained as shown in FIG. 16. In short, the reference position Gd is responsive to a duty-width chance of the HIGH-portion and LOW-portion of the NE signal.

Figure 20:
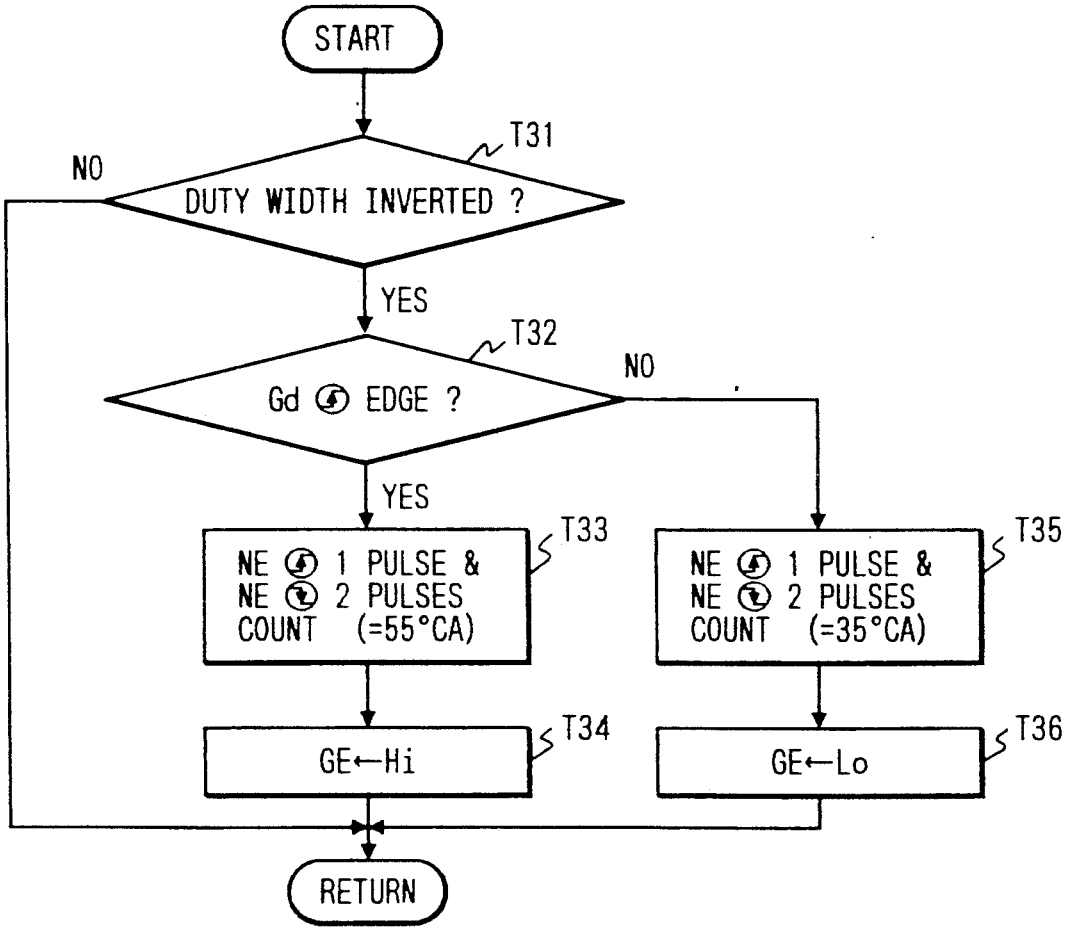
FIG. 20 is a flowchart showing a procedure for forming a specific cylinder detecting section in accordance with the second embodiment.

Next, the method of forming the specific cylinder detecting section signal GE will be explained with reference to FIG. 20. This routine is an interrupt subroutine executed by the RPD 120 only when the NE signal causes a rise. The RPD 120 makes a judgement in a step T31 as to whether or not the signal Gd is inverted, i.e. the duty-width is inverted. Then, the RPD 120 proceeds to a step T32 to make a judgement as to whether or not the Gd signal rises. If the Gd signal rises, the RPD 120 proceeds to a step T33 to cause a first delay by counting one rising pulse and two dropping pulses of the NE signal which is equivalent to 55° CA. Thereafter, the RPD 120 proceeds to a step T34 to set the GE signal to HIGH-level.

If the Gd signal drops in the step T32, the RPD 120 proceeds to a step T35 to cause a second delay by counting one rising pulse and two dropping pulses of the NE signal which is equivalent to 35° CA. Thereafter, the RPD 120 proceeds to a step T36 to set the GE signal to LOW-level.

Figure 21:
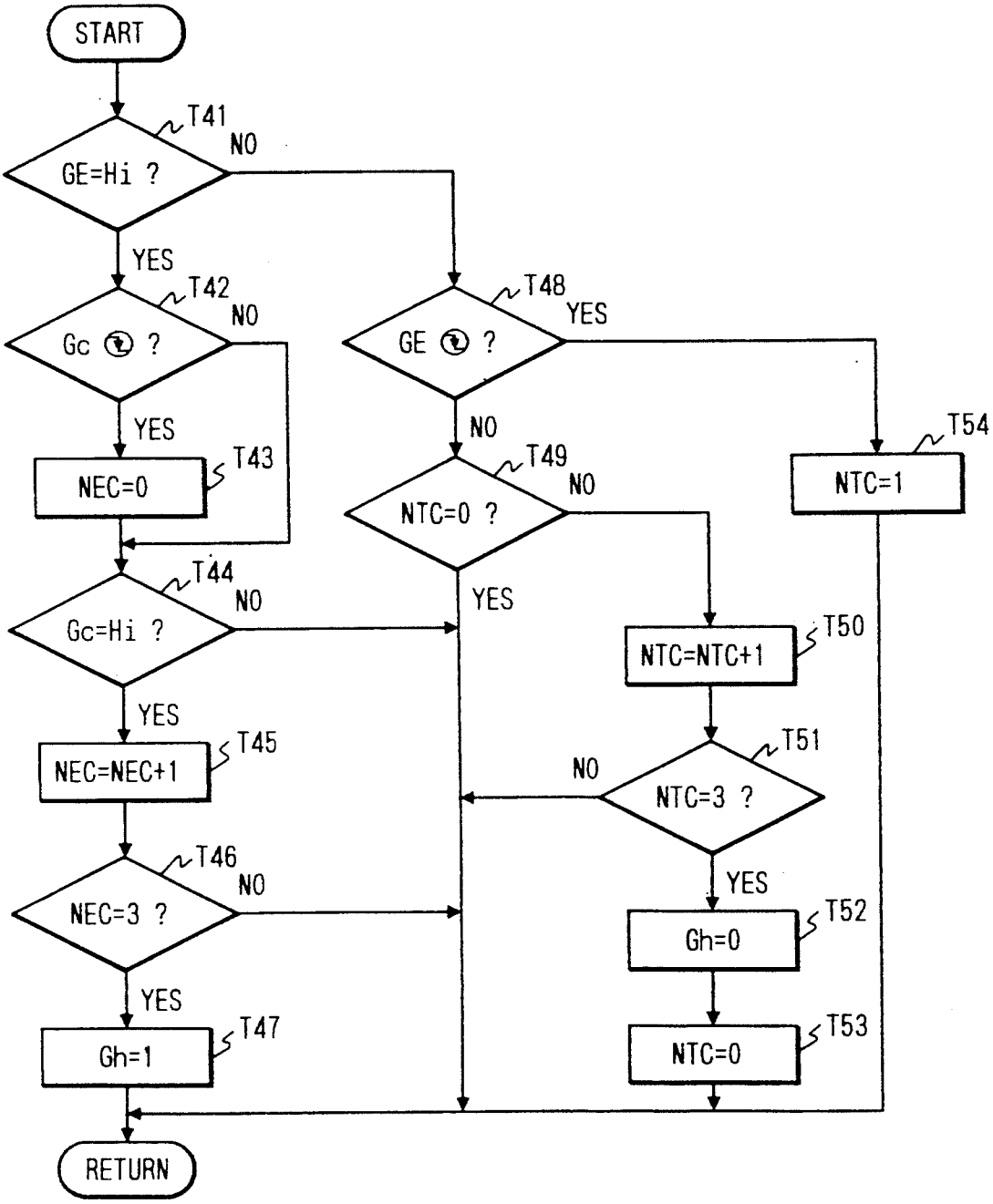
FIG. 21 is a flowchart showing a procedure for forming a specific cylinder signal in accordance with the second embodiment.

Next, the method of obtaining the specific cylinder signal Gh will be explained with reference to FIG. 21. This routine is an interrupt subroutine executed by the RPD 120 only when the NE signal causes a rise. First of all, the RPD 120 make a judgement in a step T41 as to whether or not the GE signal is HIGH-level. If the GE signal is HIGH-level, the RPD 120 proceeds to a step T42 to further make a judgement as to whether or not the Gc signal drops. If the Gc signal just drops, the RPD 120 proceeds to a step T43 to reset the NEC to "0". Then, the RPD 120 proceeds to a step T44. If the judgement is NO in the step T42, the RPD 120 directly proceeds to the step T44.

The RPD 120 make a judgement in the step T44 as to whether or not the Gc signal is HIGH-level. If the Gc signal is HIGH-level, the RPD 120 proceeds to a step T45 to increment NEC. Thereafter, the RPD 120 proceeds to a step T46 to make a judgement as to whether or not the NEC is identical with "3". If the NEC equals to "3", the RPD 120 proceeds to a step T47 to set the Gh signal to "1". The setting of the Gh signal to "1" means that the RPD 120 concludes that the present NE detecting timing corresponds to the specific cylinder.

Returning the step T41, if the GE signal is LOW, the RPD 120 proceeds to a step T48 to make a judgement whether or not the GE signal drops. If the judgement in the step T48 is NO, the RPD 120 proceeds to a step T49 to further make a judgement as to whether or not a counter NTC is "0". This counter NTC is used to determine the timing of resetting the Gh signal to "0". In this embodiment, the reset timing of the Gh signal is adjusted to be BTDC 60° CA of #1 or #6 cylinder.

If the judgement in the step T49 is NO, the RPD proceeds to a step T50 to increment NTC. Then, the RPD 120 proceeds to a step T51 to make a judgement as to whether or not the NTC is identical with "3". If the NTC equals to "3", the RPD 120 proceeds to a step T52 to reset the Gh signal to "0" and, subsequently, proceeds to a step T53 to reset the NTC to "0".

Returning to the step T48, if the judgement is YES, the RPD 120 proceeds to a step T54 to set the NTC to "1". When the judgement is NO in the steps T44, T46, T51 and YES is the step T49, the RPD 120 ends this interrupt routine.

Figure 22:
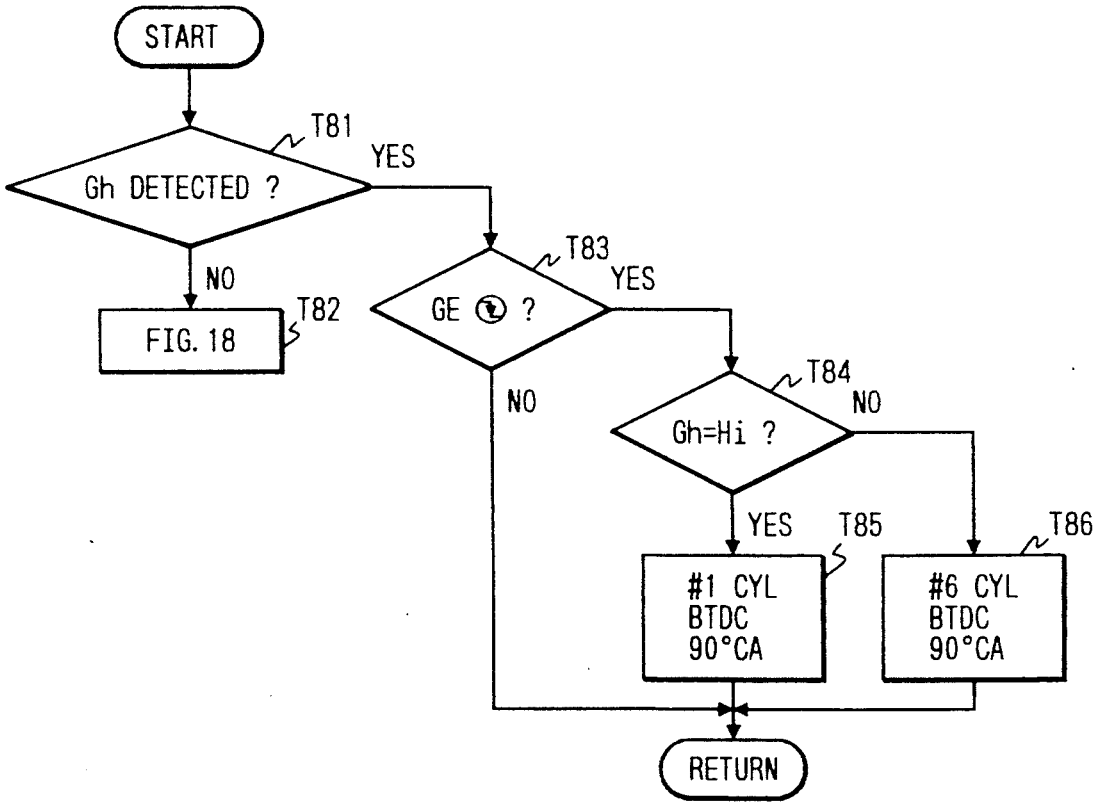
FIG. 22 is a flowchart showing a cylinder discrimination procedure in accordance with the second embodiment.

Next, the method of switching the cylinder discrimination for an engine-starting period to the auxiliary cylinder discrimination for other period will be explained with reference to FIG. 22. This routine is an interrupt subroutine executed by the CPU 150 only when the NE signal causes a rise. First of all, the CPU 150 make a judgement in a step T81 as to whether or not the Gh signal has been already detected after turning on an engine starter switch. If the Gh signal is not yet detected, the CPU 150 proceeds to a step T82 to perform the cylinder discrimination for the engine-start period defined by the flowchart of FIG. 18.

If the Gh signal is already detected in the step T81, the CPU 150 performs the auxiliary cylinder discrimination. Therefore, the CPU 150 proceeds to a step T83 to make a judgement as to whether or not the GE signal drops. If the judgement in the step T83 is YES, the CPU 150 proceeds to a step T84 to further make a judgement as to whether or not the Gh signal is HIGH-level. If the judgement is YES, the CPU 150 proceeds to a step T85 to conclude the present NE timing corresponds to BTDC 90° CA of #1 cylinder. Meanwhile, if the judgement is NO in the step T84, the CPU 150 proceeds to a step T86 to conclude the present NE timing corresponds to BTDC 90° CA of #6 cylinder.

As shown in FIG. 16, BTDC 90° CA points of #1 and #6 cylinders position just after the drop edges of the GE signal. Therefore, this routine utilizes these drop timings of the GE signal together with the signal level of the Gh signal for discriminating #1 and #6 cylinders.

Although the step T81 uses the detection of the Gh signal, this detection would be replaced by other detection such as an idle speed detection of an engine.

THIRD EMBODIMENT

Figure 23A:
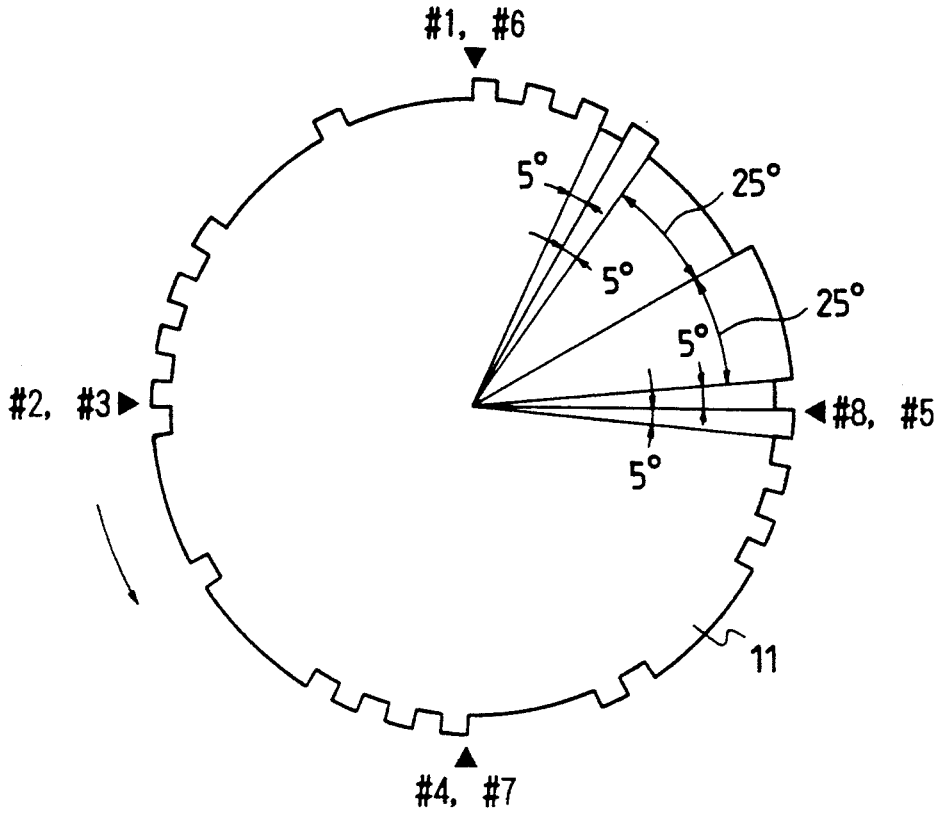
FIG. 23(A) is a view showing a crank angle rotor used in the third embodiment.

The third embodiment of the present invention omits the reference position detecting circuit 120 from the circuit configuration of FIG. 15 of the second embodiment. Instead, the crank angle rotor 11 of the crank angle detector 10 is modified into a different configuration as shown in FIG. 23(A). The cam angle rotor 21 of the cam angle detector 20 is also modified into a different configuration as shown in FIG. 23(B).

In FIG. 23(A), the crank angle rotor 11 has numerous projections and recessions alternately disposed at a circumferential peripheral portion thereof. Each of the projections and recessions has a width of 5° CA. These projections and recessions are operatively associated with the crank angle sensor 12 for generating a crank angle signal of pulsation waveform.

In FIG. 23(A), the circumferential peripheral portion of the crank angle rotor 11 is provided with two consecutive non-pulsation (or silent) sections just before respective TDCs of cylinders. The width of each non-pulsation section is 25° CA. In more detail, two non-pulsation sections of L and L levels are provided immediately before the TDC of #1, #6 cylinders. Another non-pulsation sections of L and H levels are provided immediately before the TDC of #8, #5 cylinders. Still another non-pulsation sections of H and L levels are provided immediately before the TDC of #4, #7 cylinders. And, yet another non-pulsation sections of H and H levels are provided immediately before TDC of #2, #3 cylinders. Accordingly, the crank angle rotor 11 of the third embodiment provides four different kinds of level sequences of L-L, L-H, H-L, and H-H for the discrimination of cylinders #1-#8.

Figure 23B:
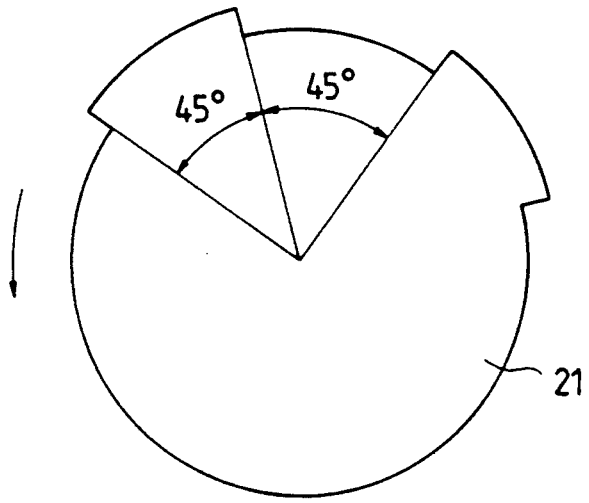
FIG. 23(B) is a view showing a cam angle rotor used in the third embodiment.

In FIG. 23(B), the cam angle rotor 21 has two projections of 45° CA spaced by one recession of 45° CA at a circumferential peripheral portion thereof. These two projections of 45° CA cooperate with the cylinder discrimination sensor 22 to generate a G signal having two, i.e., HIGH and LOW, level components.

Accordingly, combining the crank angle rotor 11 of FIG. 23(A) and the cam angle rotor of FIG. 23(B) provides eight different signal patterns suitable for the cylinder discrimination of an 8-cylinder engine.

Figures 24, 25:
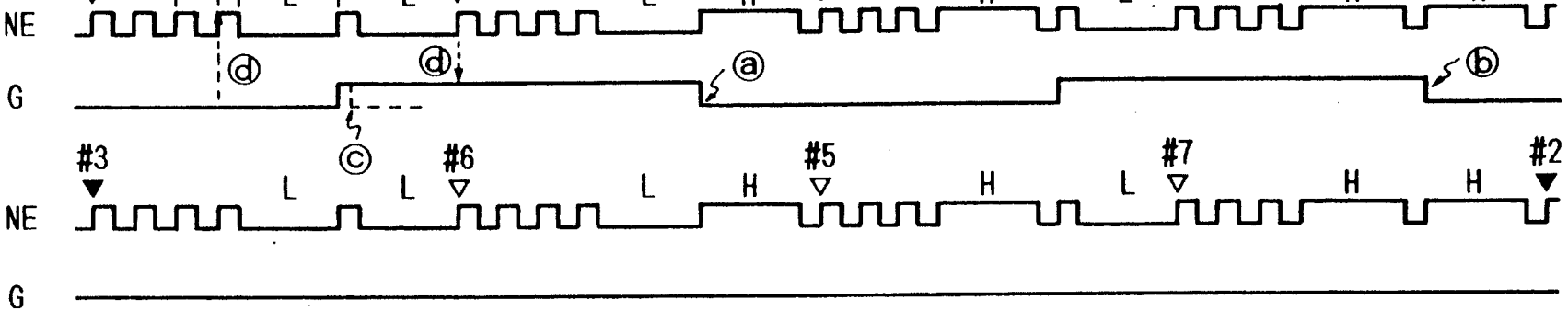
FIG. 24 is a time chart showing sensor signals used for an 8-cylinder engine in the third embodiment.
FIG. 25 is a view showing signal logic used for cylinder discrimination of the 8-cylinder engine in accordance with the third embodiment.

FIG. 24 is a time chart showing the NE and G signals. FIG. 25 summarizes the signal logic used for discriminating #1-#8 cylinders of an 8-cylinder engine.

In FIG. 24, if one ignition coil is commonly used for two or more cylinders, the G signal would be sufficient even if either a pulse (a) or a pulse (b) is eliminated. In the case where only the pulse (a) is used for such an ignition control system, the pulse (a) can be further modified into a pulse (c) as indicated by a dotted line in the drawing. Furthermore, it is needless to say that the G signal can be detected by detecting the level of G signal instead of detecting an edge of the pulse.

Figures 26, 27:
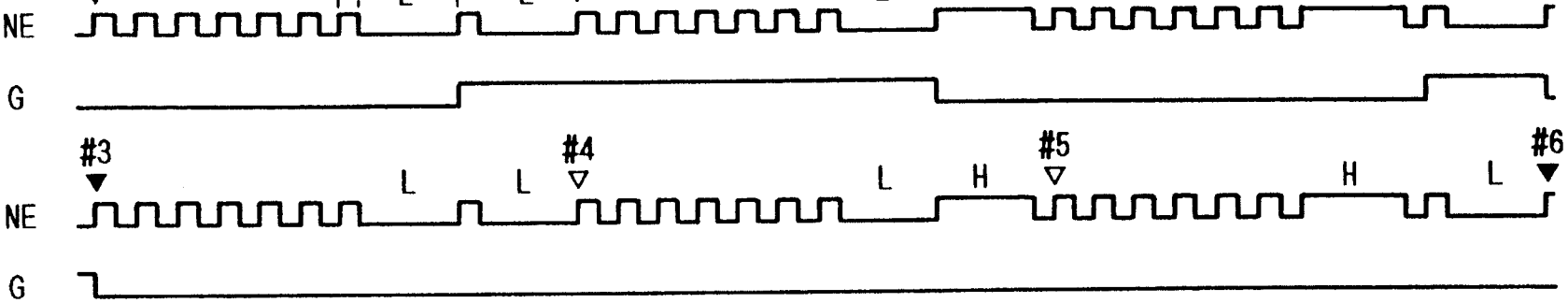
FIG. 26 is a time chart showing sensor signals used for a 6-cylinder engine in the third embodiment.
FIG. 27 is a view showing signal logic used for cylinder discrimination of the 6-cylinder engine in accordance with the third embodiment.
Figures 28, 29:
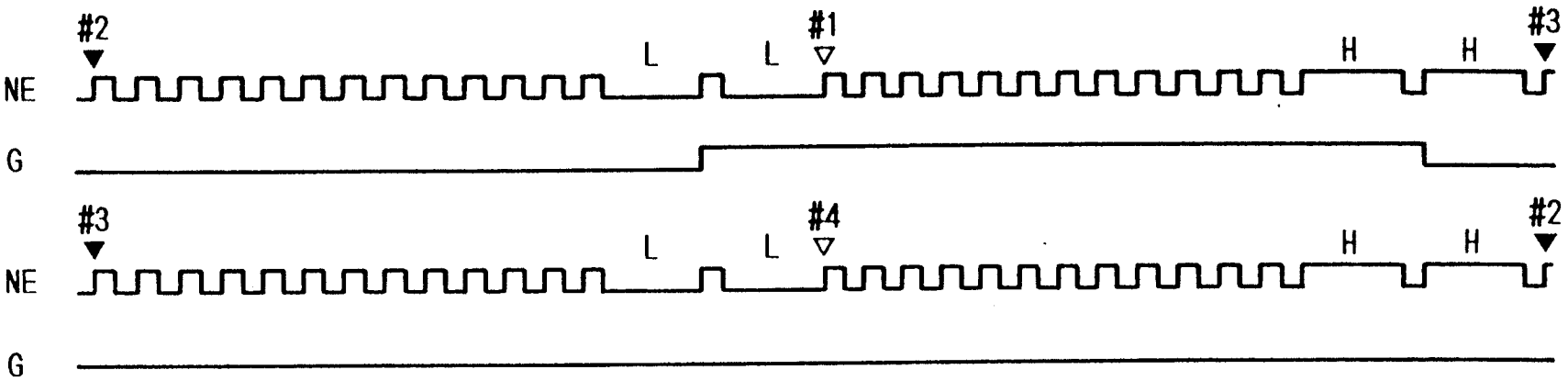
FIG. 28 is a time chart showing sensor signals used for a 4-cylinder engine in the third embodiment.
FIG. 29 is a view showing signal logic used for cylinder discrimination of the 4-cylinder engine in accordance with the third embodiment.

The principle of the cylinder discrimination method in accordance with this third embodiment can be applied to another type engine such as a 6-cylinder engine and a 4-cylinder engine. FIGS. 26 and 27 show a time chart of sensor signals and the signal logic used for discriminating #1-#6 cylinders of a 6-cylinder engine. In the same manner, FIGS. 28 and 29 show a time chart of sensor signals and the signal logic used for discriminating #1-#4 cylinders of a 4-cylinder engine.

Figure 30:
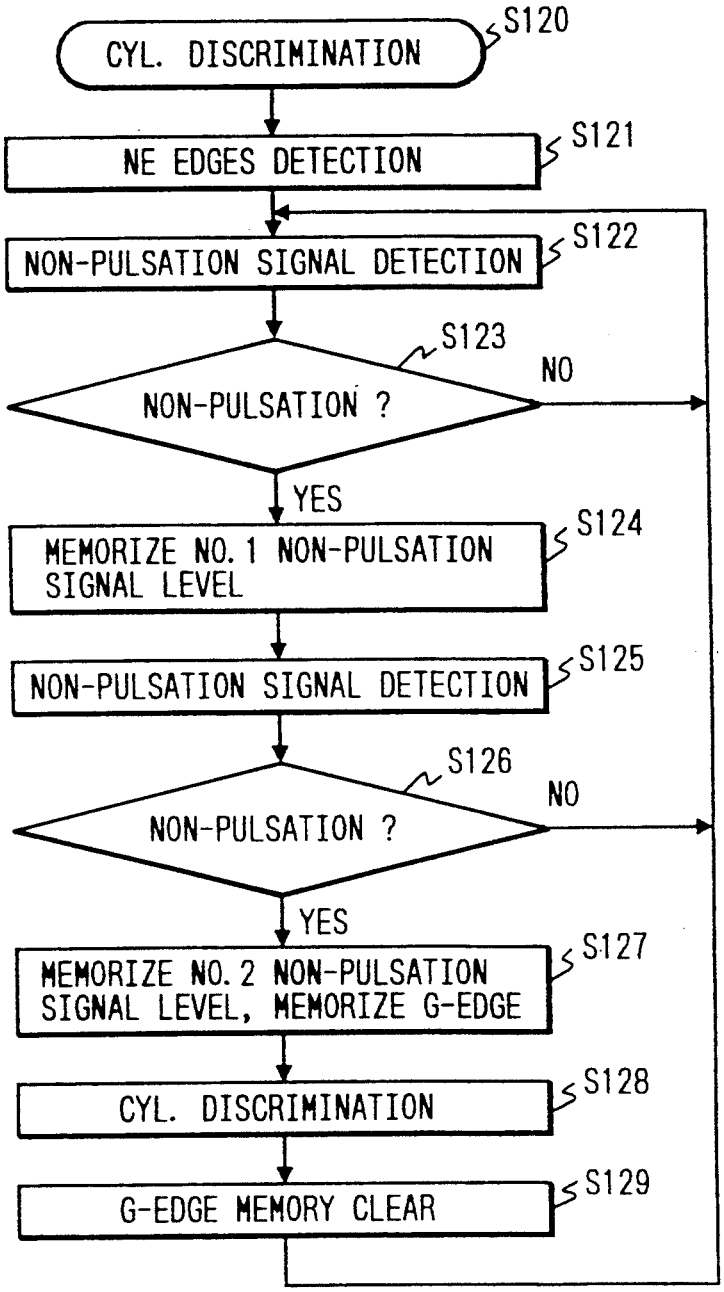
FIG. 30 is a flowchart showing a cylinder discrimination procedure in accordance with the third embodiment.
Figure 31:
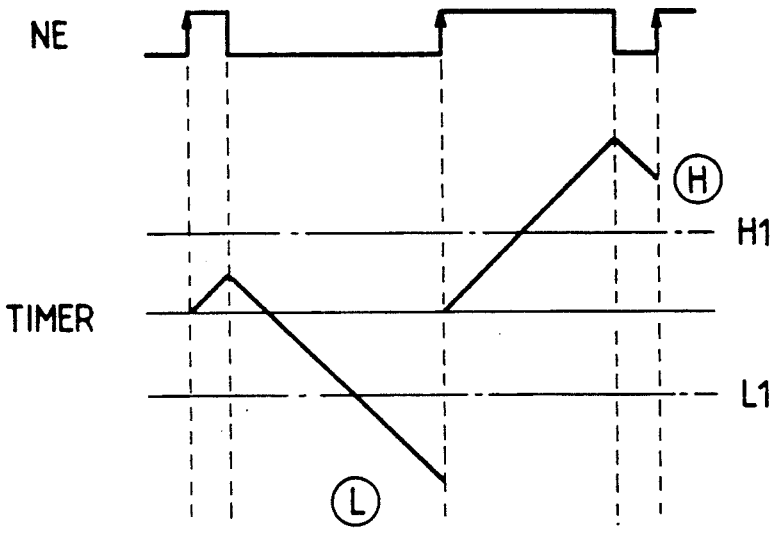
FIG. 31 is a view showing a method of detecting a non-pulsation section.

Next, an operation of the CPU 150 will be explained with reference to FIG. 30. After starting this cylinder discriminating routine in a step S120, the CPU 150 proceeds to a step S121 to continuously detect n rising pulse edges of the NE signal. For example, n is 6. Then, the CPU 150 proceeds to steps S122 and S123 to detect a non-pulsation (i.e. silent) section. This detection is, for example, carried out in the following manner. As shown in FIG. 31, an increment of a timer initiates from a rising pulse edge of the NE signal. And, a decrement of the timer initiates from a dropping pulse edge of the NE signal. If the timer count increases more than a predetermined upper threshold H1, the CPU 150 concludes that this section is an H-level non-pulsation section. On the other hand, if the timer count decreases less than a predetermined lower threshold L1, the CPU 150 concludes that this section is an L-level non-pulsation section.

If the judgement is YES in the step S123, the CPU 150 proceeds to a step S124 to memorize a signal level of the non-pulsation section detected in the steps S122 and S123. Thereafter, the CPU 150 proceeds steps S125, S126 to detect the next non-pulsation section. Then, the CPU 150 proceeds to a step S127 to memorize a signal level of the non-pulsation section detected in the steps S125 and S126. Presence of a pulse edge of the G signal is also detected in this step S127.

Thereafter, the CPU 150 proceeds to a step S128 to execute the cylinder discrimination in accordance with this third embodiment as explained with reference to FIG. 25 (i.e. an 8-cylinder engine), FIG. 27 (i.e. a 6-cylinder engine), and FIG. 29 (i.e. a 4-cylinder engine). Subsequently, the CPU 150 proceeds to a step S129 to clear a memory memorizing the presence of the pulse edge of the G-signal, and then returns to the step S122. When the judgement is NO in the steps S123, S126, the CPU 150 also returns to the step S122.

Next, let us suppose that the cam angle (i.e. cylinder discrimination) sensor 22 is of a magnetic pick-up type which has neither H or L levels. It is important in such a case how numerous patterns are provided from cam signals. The present invention utilizes two cam angle sensors as shown in FIG. 32, in order to provide signal logic usable for discriminating 8 cylinders.

In this embodiment, there is provided a 4-bit shift register 151. Upon detection of an NE signal, the CPU 150 checks the presence of G signal pulse. If G signal pulse is found, a value "1" is stored in an LSB of the register 151 and data previously stored in each bit of the shift register 151 is shifted left one by one as shown by dotted lines in FIG. 33. Then, the present embodiment performs a unique signal processing. First of all, an OR result of values in the bits 1-3 of the shift register 151 is obtained. This OR result is combined with a value of bit 0 to constitute a 2-bit signal used for the cylinder discrimination.

Figures 33, 34:
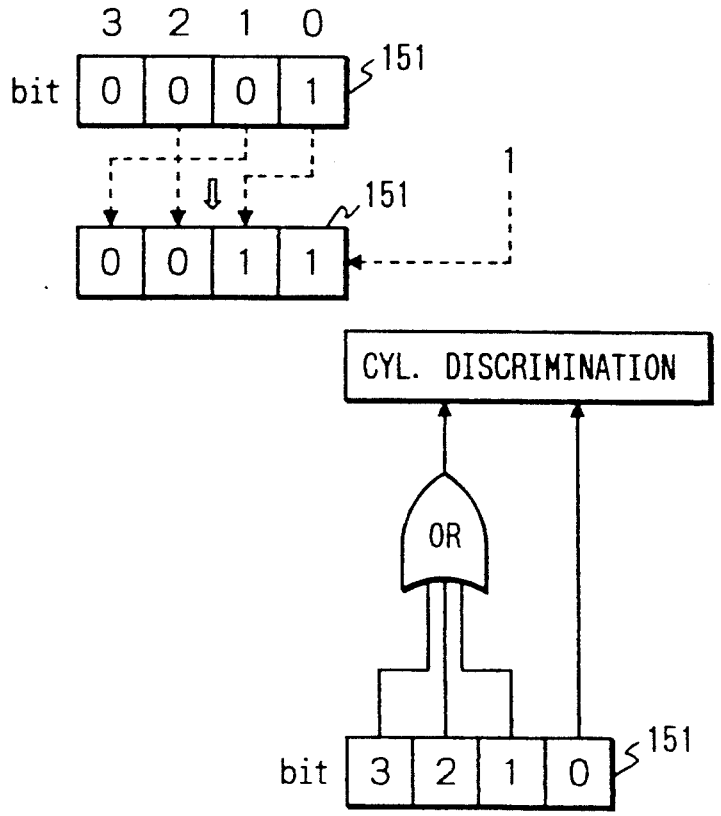
FIG. 33 is a view showing a shift register used in the third embodiment.
FIG. 34 is a view showing signal logic used for cylinder discrimination of the 8-cylinder engine in accordance with the third embodiment.

FIG. 34 shows the signal logic of 8 patterns provided by the use of two cam angle sensor signals G1, G2.

Figure 32:
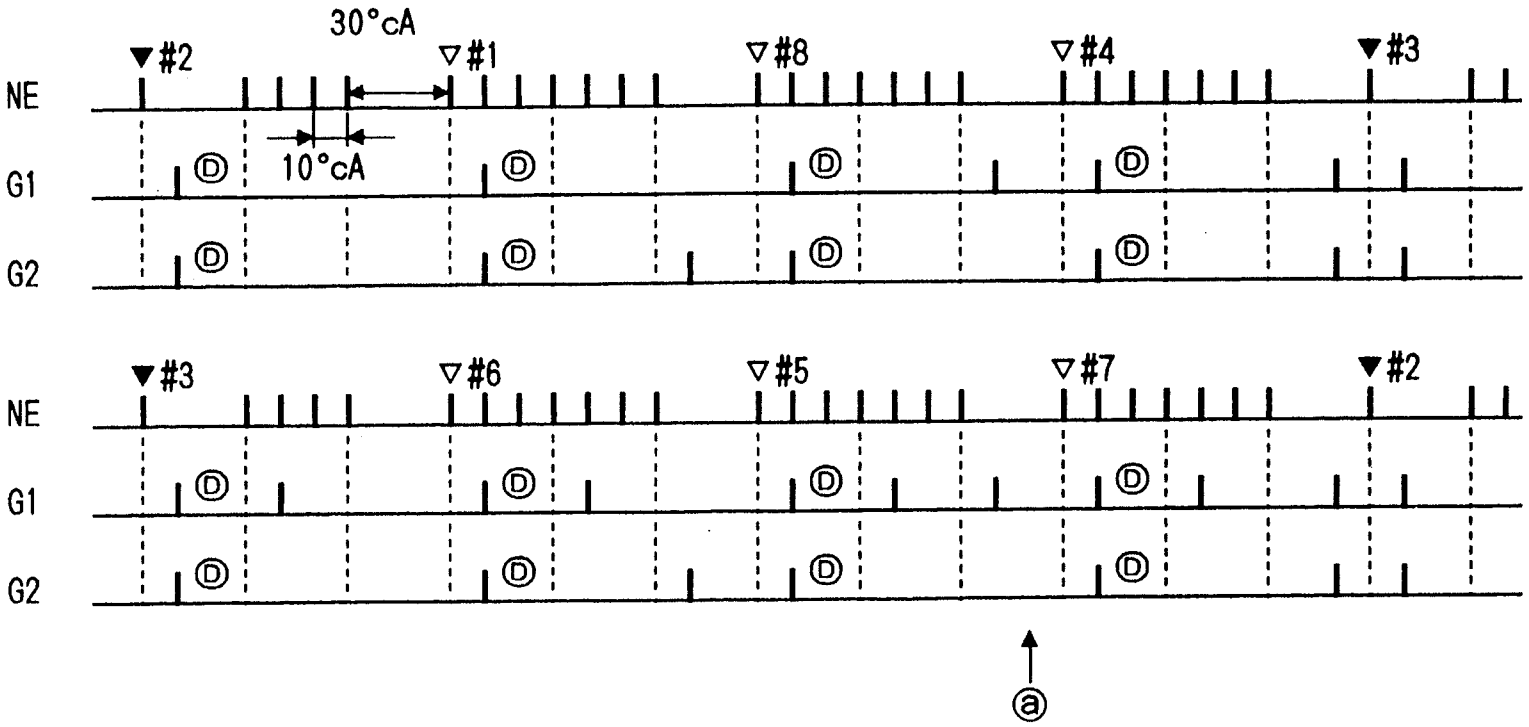
FIG. 32 is a time chart showing sensor signals used for an 8-cylinder engine in the third embodiment.

In FIG. 32, G pulse signals generally denoted by a reference character D are dummy signals. These dummy G pulse signals are provided after TDCs of respective cylinders #1-#8, in order to prevent cylinders from being mistakenly ignited even if the cam angle sensors are disabled.

For example, if the engine starts from a point (a) in the time chart of FIG. 32, the G signal pattern would be 00 under the condition that the cam angle sensors are failed. This results in that the CPU 150 mistakenly fires the #1 cylinder instead of the #7 cylinder. The present embodiment, therefore, uses dummy G signals and initiates cylinder discrimination after completing detection of these G pulses.

Figure 35:
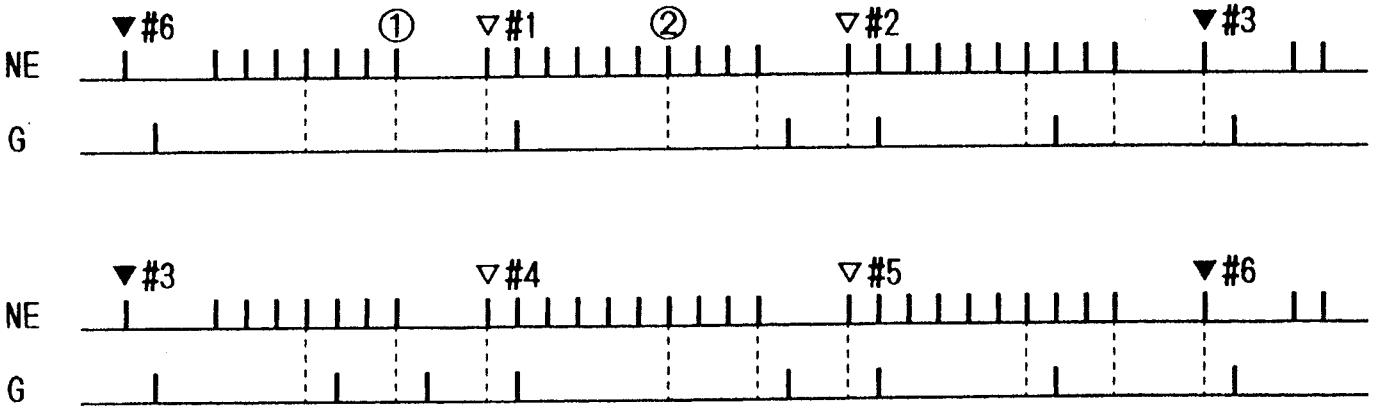
FIG. 35 is a time chart showing sensor signals used for a 6-cylinder engine in the third embodiment.
Figures 36, 37:
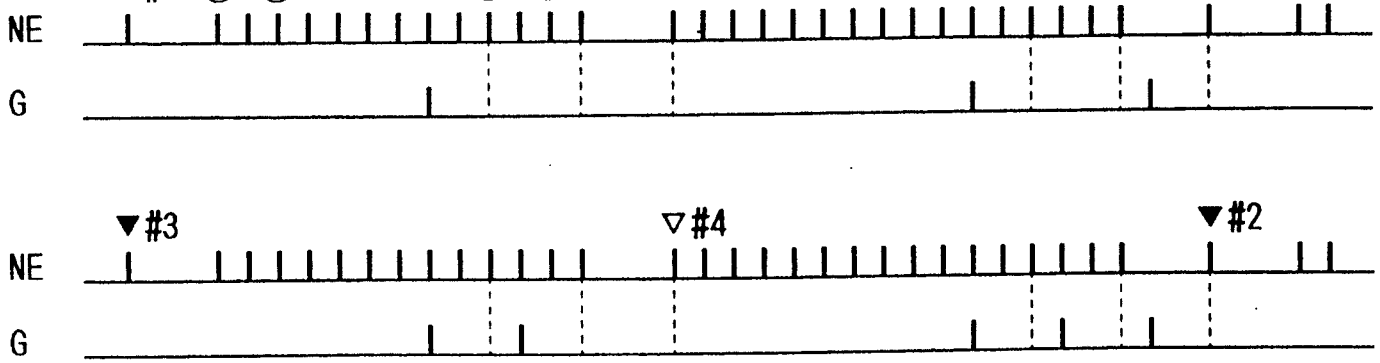
FIG. 36 is a view showing signal logic used for cylinder discrimination of the 6-cylinder engine in accordance with the third embodiment.
FIG. 37 is a time chart showing sensor signals used for a 4-cylinder engine in the third embodiment.
Figures 38, 39:
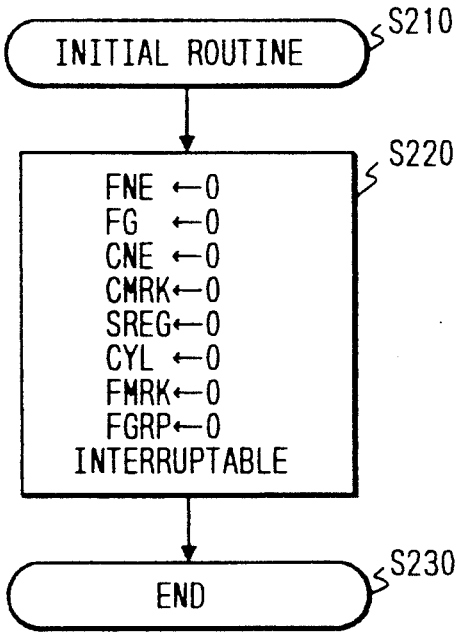
FIG. 38 is a view showing signal logic used for cylinder discrimination of the 4-cylinder engine in accordance with the third embodiment.
FIG. 39 is a flowchart showing an initial routine in accordance with the third embodiment.

Although the example of FIGS. 32-34 is based on an 8-cylinder engine, the principle of this cylinder discrimination method can be equally applied to another type engine such as a 6-cylinder engine and a 4-cylinder engine. FIGS. 35 and 36 show a time chart of sensor signals and the signal logic used for discriminating #1-#6 cylinders of a 6-cylinder engine. In the same manner, FIGS. 37 and 38 show a time chart of sensor signals and the signal logic used for discriminating #1-#4 cylinders of a 4-cylinder engine. Only one cam angle sensor will be used in case of a 4- or 6-cylinder engine.

Next, an operation of the CPU 150 will be explained with reference to FIGS. 39-43. FIG. 39 shows an initial routine. Upon turning on a starter switch, the CPU 150 initiates this routine from a step S210. The CPU 150 initializes various parameters in a step S220 and becomes an interruptable condition.

A flag FNE indicates if NE pulses are detected predetermined times. A flag FG indicates if the G pulse is detected. A counter CNE counts the NE pulses. A counter CMRK counts NE pulses in a non-pulsation section. A shift register SREG memorizes the presence of the G pulse. A data CYL is a RAM value specifying a cylinder number. A flag FMRK indicates if a non-pulsation section is detected. And, a flag FGRP indicates that the discrimination of an ignition group is completed. At a step S230, the CPU 150 ends this routine.

Figure 40:
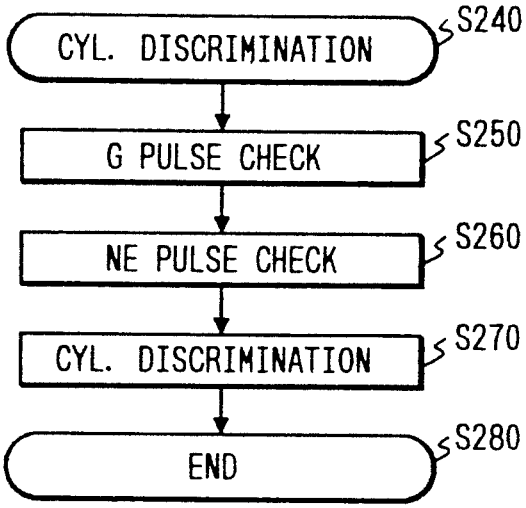
FIG. 40 is a flowchart showing a cylinder discriminating routine in accordance with the third embodiment.

FIG. 40 shows a cylinder discrimination routine. This routine is an interrupt routine which initiates in response to the detection of a pulse edge of the NE signal. After initiating this routine at a step S240, the CPU 150 proceeds to steps S250 and S260 to check the G pulse and the NE pulse, respectively. Then, the CPU 150 proceeds to a step S270 to execute cylinder discrimination and, thereafter, ends this routine at a step S280.

Figure 41:
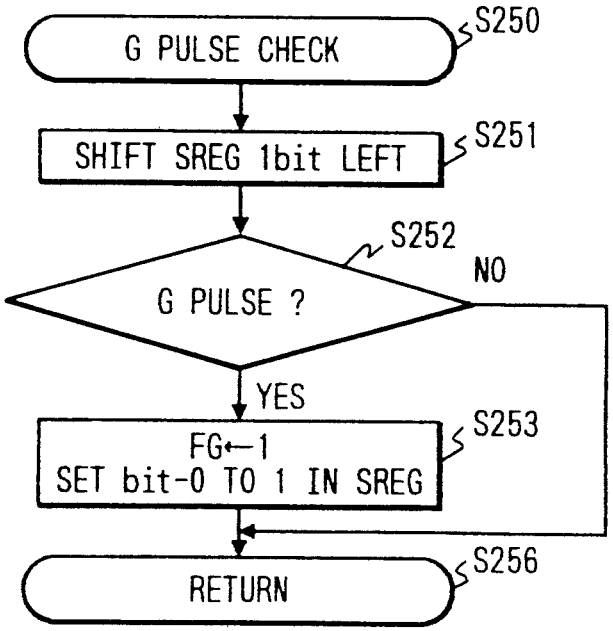
FIG. 41 is a flowchart showing a G-pulse check routine in accordance with the third embodiment.

Hereinafter, each of the steps S250, S260, and S270 will be explained in detail with reference to FIGS. 41, 42, and 43. FIG. 41 shows details of the G pulse check of the step S250. After starting this step S250, the CPU 150 shifts the SREG one bit left in a step S251. Then, the CPU 150 proceeds to a step S252 to make a judgement as to whether or not the G pulse is detected. If the G pulse is detected, the CPU 150 proceeds to a step S253 to set the FG to "1" and also set a bit-0 of the SREG to "1". Thereafter, the CPU 150 ends this routine at a step S256.

Figure 42:
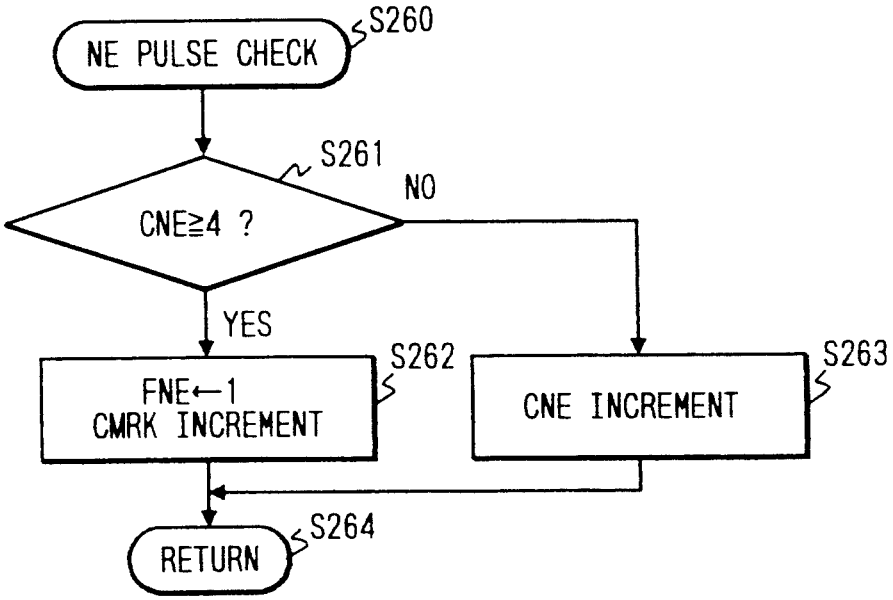
FIG. 42 is a flowchart showing an NE-pulse check routine in accordance with the third embodiment.

FIG. 42 shows details of the NE pulse check of the step S260. After starting this step S260, the CPU 150 proceeds to a step S261 to make a judgement as to whether or not the CNE is equal to or more than a predetermined value (for example "4"). If the judgement is YES in the step S261, the CPU 150 proceeds to a step S262 to set the FNE to "1" and increment the CMRK. If the judgement is NO in the step S261, the CPU 150 proceeds to a step S263 to increment the CNE. Then, the CPU 150 ends this routine at a step S264.

Figure 43:
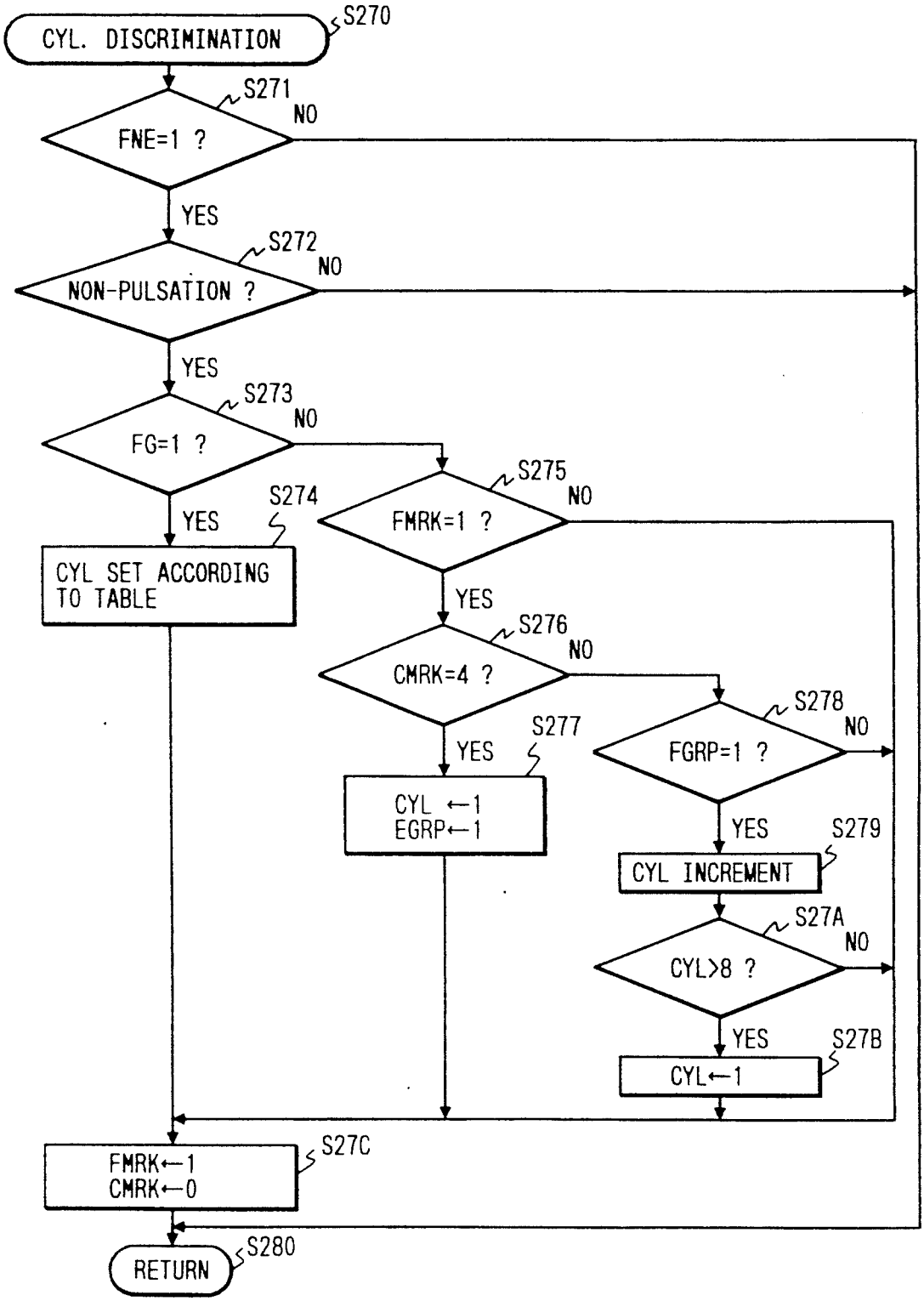
FIG. 43 is a flowchart showing a cylinder discriminating routine in accordance with the third embodiment.

FIG. 43 shows details of the cylinder discrimination of the step S270. After starting this step S270, the CPU 150 proceeds to a step S271 to make a judgement as to whether or not the FNE is equal to "1". If the judgement is YES in the step S271, the CPU 150 proceeds to a step S272 to make a judgement as to whether or not the present NE signal corresponds to a non-pulsation section. If the judgement is YES, the CPU 150 proceeds to a step S273 to make a judgement as to whether or not the FG is equal to "1". If the judgement is YES, the CPU 150 proceeds to a step S274 to specify a cylinder number according to the tables shown in FIGS. 34, 36, and 38. (For example, #1, #8, #4, - - - , #2 cylinders are assigned to "1", "2", "3", - - - , "8" according to the ignition order.)

If the FG is not identical with "1" in the step S273, the CPU 150 proceeds to a step S275 to make a judgement as to whether or not the FMRK is equal to "1". If the judgement is YES in the step S275, the CPU 150 proceeds to a step S276 to make a judgement as to whether or not the CMRK is equal to "4". If the judgement is YES in the step S276, the CPU 150 proceeds to a step S277 to set the CYL and EGRP to "1". If the judgement is NO in the step S276, the CPU 150 proceeds to a step S278 to make a judgement as to whether or not the FGRP is equals to "1".

If the judgement is YES in the step S278, the CPU 150 proceeds to a step S279 to increment the CYL and subsequently proceeds to a step S27A to further make a judgement as to whether or not the CYL is larger than a predetermined value (for example, "8"). If the judgement is YES in the step S27A, the CPU 150 proceeds to a step S27B to set the CYL to "1". The CPU 150 finally proceeds to a step S27C to set the FMRK to "1" and reset the CMRK to "0" and returns to the step S280.

The reason why the step S271 checks the FNE is to identify the cylinder only when the NE signals are detected predetermined times. Namely, the present embodiment prohibits the cylinder discrimination for a predetermined period of time after starting the engine. The reason why the step S273 checks the FG is to prevent the #1 cylinder from being mistakenly discriminated in the case where the G signal is failed as explained in the foregoing description. The procedure defined by the steps S275–S27B is therefore executed in an emergency case where the G signal is not available. These steps S275–S27B identify an ignition group on the basis of the pulse number in a non-pulsation section. If the pulse number becomes "4", the CPU 150 concludes that the present NE timing corresponds to an ignition group consisting of #1 and #6 cylinders.

FOURTH EMBODIMENT

Figures 44, 45:
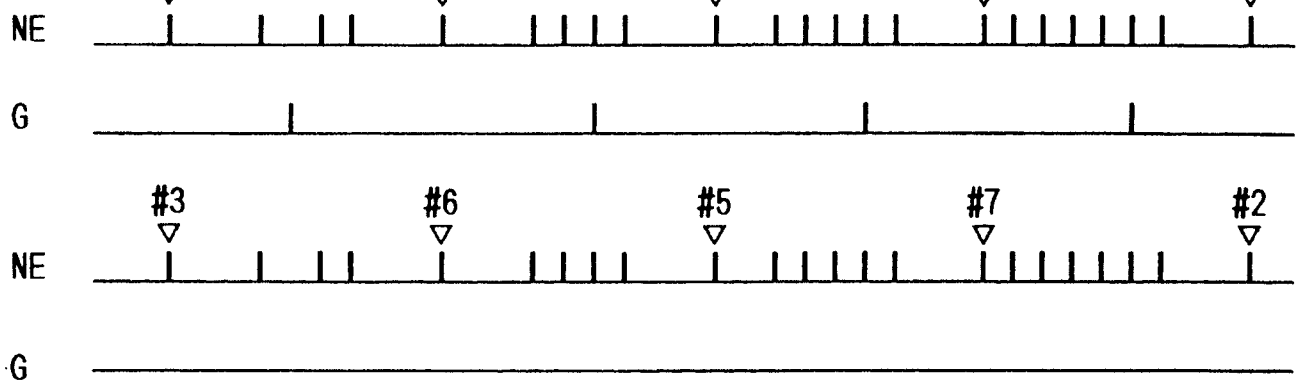
FIG. 44 is a time chart showing sensor signals used in the fourth embodiment.
FIG. 45 is a view showing signal logic used for cylinder discrimination in the fourth embodiment.

The fourth embodiment of the present invention uses NE and G sensor signals shown in FIG. 44. The signal pattern of the NE signal is characterized in that NE pulse number is differentiated variously between 3–6. Namely, the NE signal provides four different patterns. Meanwhile, the G signal two patterns. Combining these NE and G signals is, therefore, useful to provide 8 different signal patterns for the cylinder discrimination of 8-cylinder engine. FIG. 45 shows the signal logic used for the cylinder discrimination.

An operation of the CPU 150 will be explained with reference to FIG. 46. The operation of this fourth embodiment is substantially the same as that of the third embodiment except for the cylinder discrimination procedure shown in FIG. 43.

Figure 46:
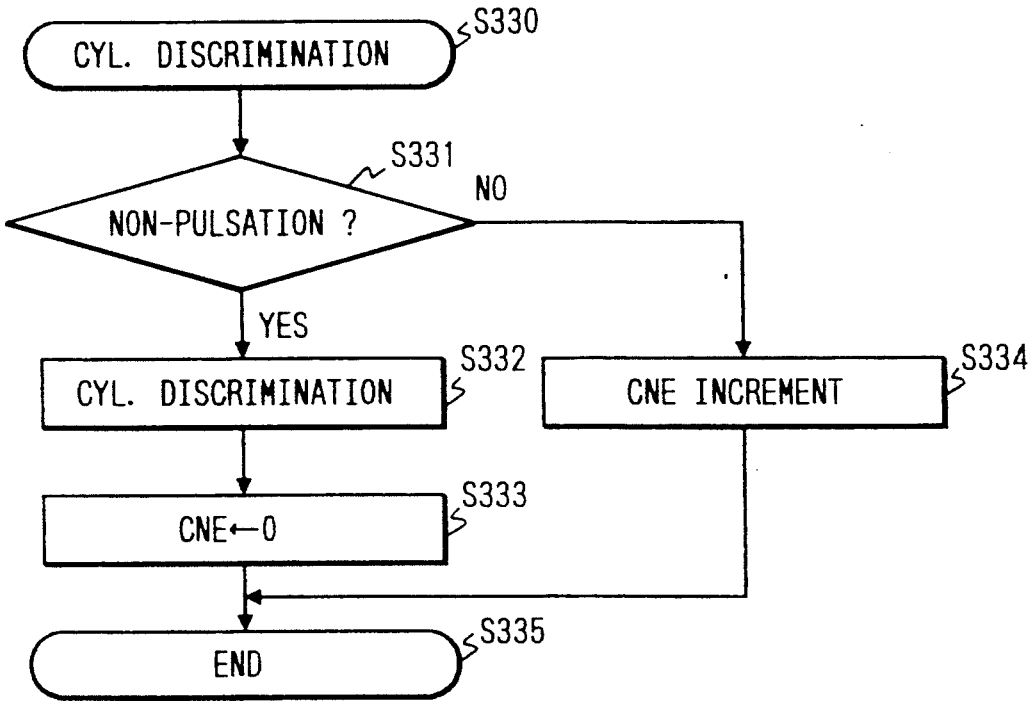
FIG. 46 is a flowchart showing a cylinder discriminating routine in accordance with the fourth embodiment.

FIG. 46 shows a cylinder discrimination procedure used in the fourth embodiment. After starting this routine at a step S330, the CPU 150 proceeds to a step S331 to make a judgement as to whether or not a non-pulsation section is detected. If the judgement is YES, the CPU 150 proceeds to a step S332 to execute the cylinder discrimination according to the table shown in FIG. 45. Thereafter, the CPU proceeds to a step S333 to reset the CNE to "0". If the judgement is NO in the step S331, the CPU 150 proceeds to a step S334 to increment the CNE.

The principle of discriminating cylinders in accordance with this fourth embodiment would be equally applied to another type engine such as a 6- or 4-cylinder engine.

As this invention may be embodied in several forms without departing from the spirit of essential characteristics thereof, the present embodiments are therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. An engine control apparatus comprising:

a crank angle rotor having a configuration representing a crank angle of an engine;

a crank angle sensor operatively associated with said crank angle rotor to generate a crank angle signal in accordance with said configuration of said crank angle rotor;

said configuration of said crank angle rotor including first and second silent sections, said first silent section being cooperative with said crank angle sensor to constitute a means for generating a first level non-pulsation component of said crank angle signal, and said second silent section being cooperative with said crank angle sensor to constitute a means for generating a second level non-pulsation component of said crank angle signal;

a cam angle rotor having a configuration representing a cam angle of the engine;

a cam angle sensor operatively associated with said cam angle rotor for generating a cam angle signal to provide a plurality of different kinds of signal level sequences with respect to said first and second silent sections of said crank angle rotor; and a cylinder discriminating means for discriminating each cylinder of said engine on the basis of said first and second level non-pulsation components of said crank angle signal and said signal level sequences of said cam angle signal.

2. An engine control apparatus in accordance with claim 1, wherein said first and second silent sections of said crank angle rotor are disposed in such a manner that consecutive two first silent sections are followed by consecutive two second silent sections, and there is provided an ignition group discriminating means for discriminating an ignition group on the basis of sequence of signal levels of said silent sections.

3. An engine control apparatus comprising:

a crank angle rotor for detecting a crank angle of an engine, said crank angle rotor having numerous projections and recessions alternately disposed at a circumferential peripheral portion thereof;

a crank angle sensor operatively associated with said alternate projections and recessions for generating a crank angle signal of pulsation waveform;

said circumferential peripheral portion of said crank angle rotor further forming two kinds of silent sections for generating non-pulsation signal components, one group of said silent sections generating a predetermined first level components and the other group of said silent sections generating a predetermined second level components, said one and the other groups being identical with each other in number, and total number of said silent sections being half of the number of cylinders of said engine;

a cam angle rotor for detecting a cam angle of said engine, said cam angle rotor having projections and recessions at a circumferential peripheral portion thereof, so as to provide two signal level components;

a cam angle sensor operatively associated with said projections and recessions of said cam angle rotor to provide a plurality of different kinds of signal level sequences with respect to said silent sections of said crank angle rotor; and a cylinder discriminating means for discriminating said cylinders of the engine on the basis of signal level of said non-pulsation components and said signal level sequence.

4. An engine control apparatus in accordance with claim 3, wherein said plurality of silent sections of said crank angle rotor are disposed in such a manner that consecutive two sections belonging to said one group are followed by consecutive two sections belonging to said the other group, and there is provided an ignition group discriminating means for discriminating an ignition group on the basis of sequence of signal levels of said silent sections.

5. An engine control apparatus comprising:

crank angle signal generating means for generating a crank angle signal of pulsation waveform in response to rotation of a crank shaft of an engine;

cylinder discriminating signal generating means for generating a cylinder discriminating signal in response to rotation of a half-speed rotor rotating at a half speed of said crank shaft, said cylinder discriminating signal including a plurality of different kinds of pulses corresponding to respective cylinders of said engine; and cylinder discriminating means for discriminating each cylinder of said engine on the basis of signal level of said crank angle signal at each pulse edge of said cylinder discriminating signal and number of pulse edges of said crank angle signal encompassed between rise and drop edges of each pulse of said cylinder discrimination signal.

6. An engine control apparatus in accordance with claim 5, wherein a specific cylinder is differentiated from other cylinders in number of pulses edges of said crank angle signal encompassed between said rise and drop edges of each pulse of said cylinder discrimination signal.

7. An engine control apparatus in accordance with claim 6, further comprising auxiliary cylinder discriminating means for discriminating each cylinder of said engine only when the engine has just started, wherein said auxiliary cylinder discriminating means identifies the specific cylinder by counting pulse edges of said crank angle signal encompassed between said rise and drop edges of each pulse of said cylinder discrimination signal.

8. An engine control apparatus in accordance with claim 6, further comprising means for generating a reference position signal (Gd) in response to said crank angle signal.

9. An engine control apparatus in accordance with claim 8, further comprising means for restricting a section (GE) for detecting the specific cylinder.

10. an engine control apparatus comprising:

a crank angle rotor for detecting a crank angle of an engine, said crank angle rotor having numerous projections and recessions alternately disposed at a circumferential peripheral portion thereof;

a crank angle sensor operatively associated with said alternate projections and recessions for generating a crank angle signal of pulsation waveform including at least two signal levels;

a half-speed rotor rotating at a half speed of said crank angle rotor, said half speed rotor being associated with a half-speed rotor angle sensor so as to generate a cylinder discrimination signal of pulsation waveform, said cylinder discrimination signal including a plurality of different kinds of pulses, said pulses being provided the same number as cylinders of said engine;

said projections and recessions of said crank angle rotor being disposed to provide a different kind of signal level sequences with respect to rise and drop edges of each pulse of said cylinder discrimination signal and also to provide different number of pulse edges of said crank angle signal between said rise and drop edges of each pulse of said cylinder discrimination signal; and cylinder discriminating means for discriminating each cylinder of said engine on the basis of said signal level sequences and number of pulse edges.

11. An engine control apparatus comprising:

a crank angle rotor for detecting a crank angle of an engine, said crank angle rotor having numerous projections and recessions alternately disposed at a circumferential peripheral portion thereof;

a crank angle sensor operatively associated with said alternate projections and recessions for generating a crank angle signal of pulsation waveform;

said circumferential peripheral portion of said crank angle rotor further forming silent sections for generating high and low non-pulsation signal components, said silent sections being paired so that said crank angle signal provides a plurality of different kinds of signal level sequences with respect to corresponding top dead centers of cylinders of said engine;

a cam angle rotor for detecting a cam angle of said engine, said cam angle rotor having projections at a circumferential peripheral portion thereof;

a cam angle sensor for operatively associated with said projections of said cam angle rotor to provide a cam angle signal having two signal level components; and a cylinder discriminating means for discriminating said cylinders of the engine on the basis of said signal level sequences of said crank angle signal and said two signal level components of said cam angle signal.

12. An engine control apparatus in accordance with claim 11, further comprising means for prohibiting cylinder discrimination for a predetermined period of time after starting said engine.

13. An engine control apparatus comprising:

crank angle means for generating pulses near each top dead center of cylinders of an engine, said pulses being variously differentiated in number in accordance with respective cylinders;

cam angle means for generating a cam angle signal; and a cylinder discriminating means for discriminating each cylinder of said engine on the basis of number of said pulses of said crank angle means and presence of said cam signal.

* * * * *